US006790575B2

(12) United States Patent
Sasaki et al.

(10) Patent No.: US 6,790,575 B2
(45) Date of Patent: Sep. 14, 2004

(54) TWO-COMPONENT DEVELOPER, IMAGE FORMING APPARATUS, AND IMAGE FORMING METHOD

(75) Inventors: Fumihiro Sasaki, Fuji (JP); Hiroaki Matsuda, Numazu (JP); Bing Shu, Mishima (JP); Maiko Kondo, Numazu (JP); Hiroshi Nakai, Yokohama (JP); Hiroto Higuchi, Numazu (JP); Yasuaki Iwamoto, Numazu (JP); Yoshihiro Suguro, Numazu (JP); Hiroyuki Yoshikawa, Numazu (JP); Masahide Yamashita, Numazu (JP); Kazuyuki Yazaki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 119 days.

(21) Appl. No.: 10/101,756

(22) Filed: Mar. 21, 2002

(65) Prior Publication Data

US 2003/0073021 A1 Apr. 17, 2003

(30) Foreign Application Priority Data

Mar. 22, 2001 (JP) ..... 2001-83232
Mar. 23, 2001 (JP) ..... 2001-084458
Mar. 23, 2001 (JP) ..... 2001-084849

(51) Int. Cl.[7] ..... G03G 9/083

(52) U.S. Cl. ..... 430/106.1; 430/111.35; 430/111.41; 430/126; 399/119

(58) Field of Search ..... 430/110.4, 106.1, 430/111.41, 111.35, 126; 399/119

(56) References Cited

U.S. PATENT DOCUMENTS 3,562,533 A 2/1971 Doyle et al.
3,627,522 A 12/1971 Jacknow et al.
3,847,127 A 11/1974 Staudt
4,980,258 A 12/1990 Aoki et al.
5,225,303 A 7/1993 Tomita et al.
5,380,616 A 1/1995 Aoki et al.
5,403,690 A 4/1995 Kuramoto et al.
5,565,298 A 10/1996 Suguro et al.
5,840,456 A 11/1998 Tomita et al.
6,060,201 A 5/2000 Kinoshita et al.
6,120,960 A 9/2000 Aoki et al.
6,183,926 B1 2/2001 Kuroda et al.
6,221,549 B1 4/2001 Emoto et al.
6,228,550 B1 5/2001 Matsuda et al.
6,255,028 B1 7/2001 Hasegawa et al.
6,258,502 B1 7/2001 Nakamura et al.
6,303,257 B1 10/2001 Hasegawa et al.
6,335,137 B1 1/2002 Suzuki et al.
6,360,068 B1 3/2002 Kinoshita et al.
6,363,229 B1 3/2002 Shiraishi et al.
6,368,765 B2 4/2002 Izu et al.
6,395,443 B2 5/2002 Kuroda et al.
6,403,275 B1 6/2002 Kuramoto et al.
6,406,826 B1 6/2002 Suzuki et al.
6,432,589 B1 8/2002 Uchinokura et al.
6,447,973 B1 9/2002 Asami et al.
6,468,706 B2 * 10/2002 Matsuda et al. ..... 430/108.6
6,503,681 B2 1/2003 Makino et al.

FOREIGN PATENT DOCUMENTS

JP 55-127565 10/1980
JP 55-127567 10/1980
JP 55-157751 12/1980
JP 63-004278 1/1988
JP 63-004282 1/1988
JP 01-112253 4/1989
JP 7-60273 6/1989
JP 02-000877 1/1990
JP 02-043654 2/1990
JP 02-284158 11/1990
JP 04-124682 4/1992
JP 6-82227 10/1994
JP 07-295283 11/1995
JP 10-091000 4/1998

* cited by examiner

*Primary Examiner*—John Goodrow
(74) *Attorney, Agent, or Firm*—Oblon, Spivak, McClelland, Maier & Neustadt, P.C.

(57) ABSTRACT

A two component developer comprising a magnetic toner containing a binder resin and a magnetic particle, and a magnetic carrier containing a magnetic particle, wherein the magnetic toner has an average particle diameter of 4.0 to 10.0 $\mu$m, and contains 5 to 80 No. % of toner particles having particle diameter of 5 $\mu$m or less, and exhibits magnetization of 10 to 25 emu/g under magnetic field of 5 kiloersteds.

20 Claims, 3 Drawing Sheets

TWO-COMPONENT DEVELOPER, IMAGE FORMING APPARATUS, AND IMAGE FORMING METHOD

BACKGROUND OF THE INVENTION

1. Field of the Invention

This invention relates to an image forming method which utilizes an electrophotographic method or electrostatic printing method or the like applicable to copiers, printers, and fax machines and the like, an image forming apparatus, and a two-component developer applicable to image forming apparatus 2. Description of the Related Art Generally, an electrophotographic method is recognized in the art as process utilizing a photoconductive substance. In the electrophotographic method, a latent electrostatic image is formed by various methods, on a latent electrostatic image carrier such as photoconductor. The latent electrostatic image is then developed with a toner, the toner is then transferred on to a paper or the like as necessary, fixed by heating or solvent vapor, to obtain copied images or printed images.

As means for developing latent electrostatic image formed on the latent electrostatic image carrier, wet developing processes and dry developing processes may be mentioned as examples.

The wet developing processes are processes in which a liquid developer is used. For dry developing processes, examples of methods include a method in which a toner containing colorant used as one-component developer dispersed in a binding resin, or a method in which a two-component developer containing a mixture of toner and a carrier.

Although each of these different means for developing a latent electrostatic image have various advantages and shortcomings, methods which utilize a two-component developer relatively have higher possibilities in responding to a higher-speed, longer-life requirements, compared to methods which utilize a single-component developer. Accordingly, dry developing processes utilizing the two-component developer are often employed presently and is widely used for primarily in medium- to high-speed copiers and printers.

Recently, a strong demand for higher definition and higher resolution in the copied or printed images has arose. In order to obtain such images having high definition and high resolution, in Japanese Patent Publication No. H6-82227/1994 (published), Japanese Patent Publication No. H7-60273/1995 (published), Japanese Patent Application Laid-Open No. H2-877/1990 (published), Japanese Patent Application Laid-Open No. H1-112253/1989 (published), Japanese Patent Application Laid-Open No. H2-284158/1990 (published), and Japanese Patent Application Laid-Open No. H7-295283/1995 (published), propose developers having small average particle diameter defined by the contained amount of the toner particles having particle diameter of 5 μm or less, and the distribution thereof.

In these publications, it is disclosed that, toner particles having diameter of 5 μm or less are mandatory components for forming high definition, high resolution images, and such toners containing small toner particles, when supplied smoothly during the development of latent images, contribute to generate faithful images of the latent images, that is, to generate images having outstanding reproducibility which do not protrude the contour of the latent images. On the other hand, there is a problem of an edge effect phenomenon in which the density around the center of an image becomes low compared to edge portions (i.e., corners) of the image. Such phenomenon appears more conspicuously as toner particles become smaller, for example 5 μm or less. However, it also discloses that such phenomenon may be suppressed by defining the No. % of the toner particles having an intermediate particle diameter of 5 μm or greater.

Moreover, as smaller the diameter of the particles become, it becomes more advantageous in terms of forming images of high resolution and high definition even if the content of toner particles having diameter of 5 μm or less in an entire toner is 17 No. %, this accounts for no more than a mere 3 vol. % when expressed as a vol. % age. In such level of quantity, it is very difficult to selectively place toner of a small particle diameter of 5 μm or less in the peripheral portions on a latent image. Furthermore, these toner particles are magnetic toner particles, containing 50 parts by mass or more of magnetic bodies relative to the binding resin. For that reason, magnetization in a magnetic field of 1 kiloersted (1 köe=approximately 79.6 kA·m) becomes great, exceeding 20 emu/g. Accordingly, the toner becomes difficult to develop due to the magnetic bias effect, and, particularly in cases where toner having a toner particle diameter of 5 μm or less is contained in the large quantity of 60 No. %, the toner becomes excessively charged (overcharged), and developing power further deteriorates. As a consequence, image density declines sharply, and this has constituted a problem. When the toner is difficult to develop, moreover, toner builds up on the carrier surface, a phenomenon called spent occurs, and the useful life of the developer is sharply reduced, which has also constituted a problem.

In order to prevent a spent phenomenon, conventionally, methods for coating the carrier surface with various resins have been proposed. However, although carriers coated in such a manner to exhibit outstanding charge characteristics, the threshold surface tension at the surface thereof is comparatively high, for such reason, the useful life thereof as a developer is not all that long, which has been a problem.

A carrier coated with an ethylene tetrafluoride copolymer is known. With this carrier, however, even though the problem of toner becoming spent does not readily occur due to the low surface tension, because the ethylene tetrafluoride copolymer is positioned on the most negative end in the frictional charge sequence, the carrier cannot be used when trying to electrify the toner to a negative polarity, which has been a problem.

Carriers have also been proposed as carriers of low surface tension which are coated with a coating layer containing a silicone resin. Examples include a carrier the surface whereof is coated with an unsaturated silicone resin and organo-silicone or silanol or the like mixed in a styrene-acrylic resin (U.S. Pat. No. 3,562,533, specification), a carrier the surface whereof is coated with a polyphenylene resin and an organo-silicone terpolymer resin (U.S. Pat. No. 3,847,127, specification), a carrier the surface whereof is coated with a styrene-acrylate-methacrylate resin and organo-silane, silanol, or siloxane or the like (U.S. Pat. No. 3,627,522, specification), a carrier the surface whereof is coated with a silicone resin (Japanese Patent Application Laid-Open No. S55-127567/1980 (published), and a carrier the surface whereof is coated with a resin-denatured silicone resin (Japanese Patent Application Laid-Open No. S55-157751/1980 (published). Thus, by using a carrier the surface whereof is coated with a silicone resin, resistance to becoming spent is improved, but, when the amount of toner having a particle diameter of 5 μm or less is great, the recent demand for longer useful life cannot be satisfied, which has been a problem.

Art wherein a small quantity of toner particles having a diameter of 5 μm or less is defined has been proposed, in Japanese Patent Application Laid-Open No. H4-124682/1992 (published) and Japanese Patent Application Laid-Open No. H10-91000/1998 (published), for single-component developing schemes. However, there is no provision concerning particle diameter distribution in a range wherein most of the toner particles that determine image quality exist, and the effectiveness of such art is limited to single-component developing schemes wherein single-component developers are used.

With the single-component developer schemes noted above, no use is made of a developer wherein carrier particles and toner particles are mixed, as in a two-component developer scheme wherein a two-component developer is used, but toner is held on a developing sleeve, either by electrical force produced by friction between the toner and the developing sleeve, or by magnetic force between a developing sleeve having a built-in magnet or magnets and toner containing a magnetic particle. Thereby, when an approach is made close to a latent electrostatic image, a drawing force in the direction of the latent electrostatic image for the toner particles produced by an electric field formed by the latent electrostatic image overcomes the bonding force between the toner particles and the developing sleeve, in which the toner particles are drawn to and adhere to the latent electrostatic image and the latent electrostatic image is made visible. Accordingly, with a single-component developer scheme, the advantage of being able to make the developing apparatus small is gained because there is no need to control toner density, but, because the number of toner particles in the development region is few compared to a two-component developer scheme, the amount of toner development toward the photoconductor is not sufficient, making it very difficult to cope with high-speed copiers, which has been a problem.

As a method of resolving such problems, a two-component developer scheme which requires no toner density control, such as described in Japanese Patent Publication No. H5-67233/1993 (published), has been devised. In this two-component developer scheme, developer in the vicinity of the developing sleeve takes toner into the developer in the toner supply portion, and toner is charged after controlling the developer with a layer thickness controlling member, thereby gaining the advantage of requiring no replenishing mechanism for replenishing toner or sensors for detecting toner density.

However, because the amount of developer cannot be made as great as in a conventional two-component developer scheme, in the case of a high-speed machine where the linear speed of the developing sleeve becomes high, the toner cannot be sufficiently charged, and the occurrence of ground fogging has been a problem. Also, when an attempt is made to impart sufficient charging to the toner, it is necessary to make the controlling stress at the layer thickness controlling member stronger, and due to the heat generated by the mutual collisions of the developer particles, a film of toner is formed on the carrier surface, the so-called spent phenomenon ensues, carrier charge characteristics decline as the time of use lengthens, and toner scattering and ground fogging and the like develop, which has been a problem.

Also, as noted earlier, for a developer used in a miniaturized developing apparatus, because it is necessary to impart charging to the toner supplied, in a short time, large amounts of fluidity enhancers have been added to the toner so that the toner supplied would mix quickly in the developer. When developers to which large amounts of fluidity enhancers have been added are repeatedly used, however, the excessive fluidity enhancer in the toner adheres strongly to the latent electrostatic image carrier, leading to the problem of abnormal images being produced with streaks in them. When the stirring stress on the developer is made large, moreover, in addition the spent phenomenon described earlier, the amount of charging in the toner becomes greater than necessary, resulting in the so-called charged-up phenomenon, which has also been a problem.

Furthermore, with the miniaturized developing apparatus noted above, the volume of developer is small, and the volume of toner held by the developer is small. Thereupon, when an original document having a lot of image area is repeatedly copied, toner consumption becomes excessive, and the toner concentration in the developer exhibits extreme changes, so that image density declines, which has also been a problem.

Furthermore, with the miniaturized developing apparatus noted above, the amount of toner uptake is different between places where developer action is vigorous and places where it is not vigorous, and between places where there is much developer and places where there is little. Thus the toner density becomes unstable in places, and image density irregularities or fogging readily develop, which has been a problem. Hoping to resolve such problems as this, in Japanese Patent Application Laid-Open No. S63-4282/1988 (published), art is disclosed for placing two toner supply members in the toner hopper, and causing developer to pass along the paths formed by those toner supply members, thereby resolving the problems of density irregularity and fogging in the long direction of the apparatus. With the art disclosed in that publication, however, because two toner supply members are used, the size of the developing unit becomes large and costs increase, which are problems. In this art, moreover, toner particle diameter and particle diameter distribution are critical. More specifically, when the numbers of particles measuring 5 μm or less becomes great, toner fluidity deteriorates, and the problem of toner uptake becoming destabilized is encountered. When there are many large, coarse particles in the toner, moreover, the actual toner uptake amount decreases, and, particularly in cases where images that consume a large amount of toner are output, image density declines, and this too has been a problem.

Hoping to resolve such problems as these, many methods have been proposed which define the mean particle diameters, and the quantities to be added, of fluidity enhancers. In Japanese Patent Application Laid-Open No H2-43654/1990, for example, a method is proposed where fine silica powder having an average particle diameter of 0.05 μm or less and titanium oxide particles having an average particle diameter of 0.1 μm or less are added. However, although the addition of titanium oxide particles is effective in terms of environmental stability and image density stabilization, when a fluidity enhancer having an average particle diameter of 0.1 μm or greater is used, the toner separates in the developing machine, and this has been a problem because it has resulted in ground fogging caused by toner fluidity deterioration and other factors detrimental to image quality.

SUMMARY OF THE INVENTION

The purpose of the present invention is to resolve the problems in the prior art described in the foregoing and to achieve the following objects. A first object of the present invention is to provide a two-component developer in which adequate charging is imparted to the toner and good images can be obtained which exhibit no toner scattering or texture smudging, an efficient image forming method which uses that two-component developer, and an image forming apparatus which carries that two-component developer and yields good images exhibiting no toner scattering or texture smudging.

A second object of the present invention is to provide a two-component developer in which good images can be obtained which excel in the reproducibility of fine lines and intermediate tones, an efficient image forming method which uses that two-component developer, and an image forming apparatus which carries that two-component developer and yields good images exhibiting no toner scattering or texture smudging.

A third object of the present invention is to provide a two-component developer which excels in environmental stability, and in stability over time when used for extended periods, an efficient image forming method which uses that two-component developer, and an image forming apparatus which carries that two-component developer and excels in environmental stability, and in stability over time when used for extended periods.

A fourth object of the present invention is to provide an image forming method and image forming apparatus small of size and inexpensive, which require no toner replenishing mechanism or toner density sensors, and a two-component developer to be carried in that image forming apparatus.

DESCRIPTION OF THE PREFERRED EMBODIMENTS

Two-Component Developer

Figure 1:
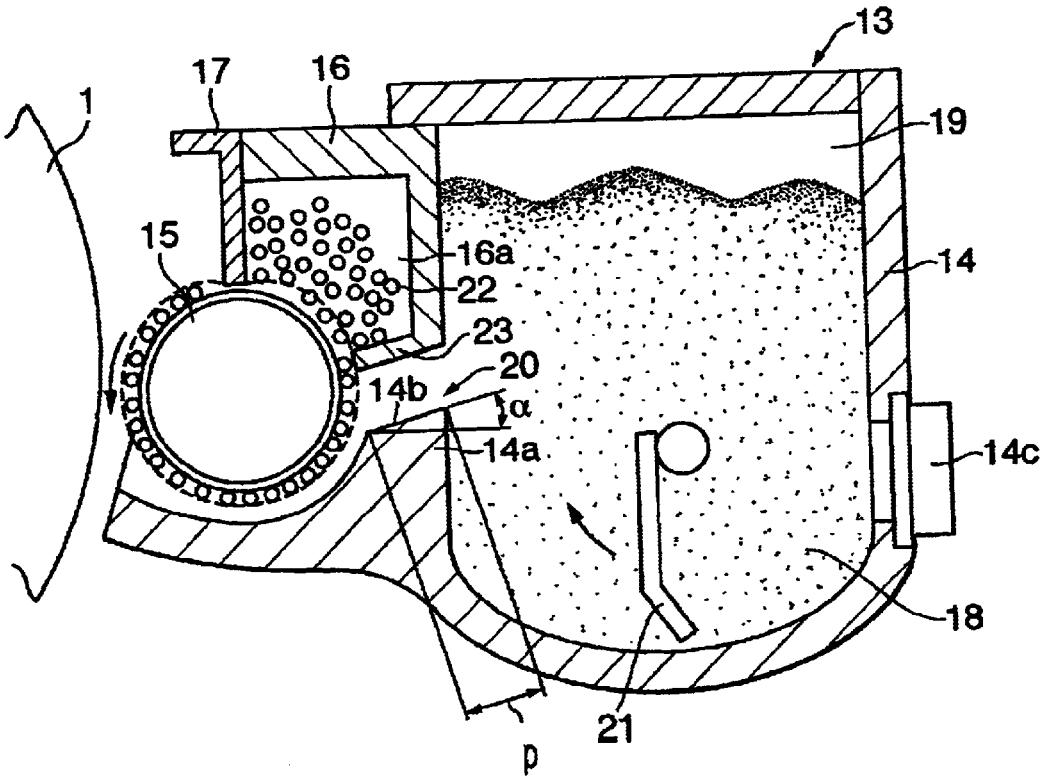
FIG. 1 is a schematic view of a developing apparatus in an image forming apparatus, for describing one embodiment aspect of the image forming apparatus and image forming method of the present invention.

The two-component developer of the present invention contains a magnetic toner comprising a binding resin and a magnetic particle, and a magnetic carrier comprising a magnetic particle. The magnetic toner of this two-component developer has a weight-average particle diameter of 4.0 to 10.0 μm, and contains 5 to 80 No. % of toner particles having a particle diameter of 5 μm or less, and exhibits a magnetization of 10 to 25 emu/g in a 5-kiloersted magnetic field.

For the two-component developer of the present invention, the first to third aspects described below are preferable.

The two-component developer of the present invention in the first aspect contains a magnetic toner comprising a binding resin and a magnetic particle, and a magnetic carrier comprising a magnetic particle. The magnetic toner of this two-component developer has a weight-average particle diameter of 6.0 to 8.0 μm, and contains 40 to 80 No. % of toner particles having a particle diameter of 5 μm or less, and exhibits a magnetization of 7 to 20 emu/g in a 1-kiloersted magnetic field.

The two-component developer of the present invention in the second aspect contains a magnetic toner comprising a binding resin and a magnetic particle, and a magnetic carrier comprising a magnetic particle. The magnetic toner of this two-component developer has a weight-average particle diameter of 6.0 to 10.0 μm, and contains 5 to 60 No. % of magnetic toner particles having a particle diameter of 5 μm or less, contains 2 vol. % or more of magnetic toner particles having diameter of 12.7 μm or greater.

The two-component developer of the present invention in the third aspect contains a magnetic toner comprising a binding resin and a magnetic particle, and a magnetic carrier comprising a magnetic particle. The magnetic toner of this two-component developer contains 5 vol. % or less of toner particles having a particle diameter which is greater than the weight-average particle diameter by twice or more, with the ratio between the number-average particle diameter (D25) and the number-average particle diameter (D75) which is expressed by D25/D75, is 0.60 or greater, contains 5 to 60 No. percent of toner particles having a diameter of 4 μm or less.

Magnetic Toner

Physical Properties of Magnetic Toner

In the first aspect described above, it is preferable in the interest of obtaining high definition and high resolution that the magnetic toner contains 40 to 80 No. % of and more preferably 40 to 60 No. % of toner particles having a particle diameter of 5 μm or less, based on the total toner.

In the first aspect, when the content of toner particles having diameter of 5 μm or less is less than 40 No. %, the minute particles for faithfully reproducing the latent electrostatic image decrease, particularly when outputting images of high resolution, the problem of deteriorating reproducibility sometimes arises. When the large, coarse particles are numerous, moreover, the amount of actual toner uptake decreases, and, particularly in cases where images that consume a large amount of toner are output, image density sometimes declines, which is a problem.

When the content of toner particles having diameter of 5 μm or less exceeds 80 No. %, on the other hand, the fluidity as toner deteriorates, and toner uptake is not performed smoothly, so that image density irregularity due to toner density irregularity sometimes readily occurs.

In the second aspect, in the interest of preventing density irregularities in the images obtained, by the stability of toner uptake resulting from toner fluidity and developer action, it is preferable that the magnetic toner contains 5 to 60 No. %, and more preferably 15 to 40 No. % of toner particles having diameter of 5 μm or less, based on the total toner.

In the second aspect, when the content of toner particles having diameter of 5 μm or less is less than 5 No. %, the quantity of minute particles for faithfully reproducing the latent electrostatic image decreases, and particularly when outputting images of high resolution, the problem of deteriorating reproducibility sometimes arises. When that amount exceeds 60 No. %, on the other hand, the fluidity as toner deteriorates, and toner uptake is not performed smoothly, so that image density irregularity due to toner density irregularity sometimes readily occurs.

In the third aspect, in the interest of preventing density irregularities in the images obtained, by the stability of toner uptake resulting from toner fluidity and developer action, it is preferable that the magnetic toner contains 5 to 60 No. % and more preferably 15 to 40 No. % of toner particles having diameter of 4 μm or less based on the total toner.

In the third aspect, when the content of toner particles having diameter of 4 μm or less is less than 5 No. %, the quantity of minute particles for faithfully reproducing the latent electrostatic image decreases, particularly when outputting images of high resolution, the problem of deteriorating reproducibility sometimes arises. When that content exceeds 60 No. %, on the other hand, the fluidity as toner deteriorates, and toner uptake is not performed smoothly, so that image density irregularity due to toner density irregularity sometimes readily occurs.

In the first aspect, the weight-average particle diameter of the magnetic toner should be 6.0 to 8.0 μm, and preferably 7.0 to 8.0 μm.

In the first aspect, when the weight-average particle diameter is less than 6.0 μm, the electrical charge on the toner becomes high when it is used for a long time, and image density declines, and problems such as a decline in image density, particularly in a low-humidity environment, sometimes tend to arise. When the weight-average particle diameter exceeds 8.0 μm, on the other hand, the resolution of minute spots at 1200 dpi is not adequate, there is also much scattering to non-image portions, and image quality sometimes deteriorates.

In the second aspect, the weight-average particle diameter of the magnetic toner should be 6.0 to 10.0 μm, and preferably 8.0 to 10.0 μm.

In the second aspect, when the weight-average particle diameter is less than 6.0 μm, the electrical charge on the toner becomes high when it is used for a long time, and image density declines, and problems such as a decline in image density, particularly in a low-humidity environment, sometimes tend to arise. When the weight-average particle diameter exceeds 10.0 μm, on the other hand, the resolution of minute spots measuring 100 μm or less is not adequate, there is much scattering to non-image portions, and image quality sometimes deteriorates.

In the third aspect, the weight-average particle diameter of the magnetic toner should be 4.0 to 10.0 μm, and preferably 5.0 to 8.0 μm.

In the third aspect, when the weight-average particle diameter is less than 4.0 μm, the electrical charge on the toner becomes high when it is used for a long time, and image density declines, and problems such as a decline in image density, particularly in a low-humidity environment, sometimes tend to arise. When the weight-average particle diameter exceeds 10.0 μm, on the other hand, the resolution of minute spots measuring 100 μm or less is not adequate, there is much scattering to non-image portions, and image quality sometimes deteriorates.

In the third aspect, moreover, the magnetic toner should contain 5 vol. % or less, and preferably 3 vol. % or less, of toner particles having a particle diameter that is twice or more greater than the weight-average particle diameter noted above.

When the amount of toner particles having a particle diameter of twice or more the weight-average particle diameter (large, coarse particles) contained exceeds 5 vol. %, the actual amount of toner uptake decreases, fine line reproducibility deteriorates, and image density sometimes declines, particularly when outputting an image that consumes a large volume of toner.

In the third aspect, furthermore, in the magnetic toner, the ratio of the number-average particle diameter (D25) to the number-average particle diameter (D75), which is expressed by D25/D75, should be 0.60 or greater and preferably 0.70 or greater.

When the ratio (D25/D75) is less than 0.60, the particle diameter distribution becomes broad, and the behavior of the toner particles becomes uneven, the uptake of magnetic toner into the two-component developer becomes uneven, and partial image density irregularity sometimes occurs.

In the present invention, furthermore, the particle distribution of the magnetic toner may be measured by any of various commonly known methods, but, in the present invention, measurements were made as noted below using a Coulter counter.

Measurement

Using a model TA-II Coulter counter (manufactured by Coulter Co.) as the measurement apparatus, a PC 9801 personal computer (manufactured by NEC) and an interface (manufactured by Nikkaki [-Bios] Co.) for outputting numerical and volumetric distributions were connected, and, using primary sodium chloride as an electrolyte, a 1 percent NaCl aqueous solution was prepared.

As to the measurement method, to 10 to 15 ml of the electrolytic aqueous solution noted above were added 0.1 to 5 ml of a surfactant (alkylbenzene sulfonate being preferable) as a dispersant, to that were added 2 to 20 mg of the measurement sample, and this was subjected to a dispersion process for approximately 1 to 3 minutes in an ultrasonic dispersing machine to yield a sample dispersion liquid. Then, 100 to 200 ml of the electrolytic aqueous solution were placed in a separate beaker, and into that was added the sample dispersion liquid, to a prescribed concentration, to yield a sample liquid. Measurement was performed on this sample liquid, using the measurement apparatus noted above (i.e. the model TA-II Coulter counter), using an aperture of 100 μm to measure the particle diameter distribution of particles having diameters of 2 to 40 μm, based on the number of particles. The volumetric distribution and numerical distribution of particles having diameters of 2 to 40 μm were calculated, and the weight-average particle diameter (D4: taking the center value of the channels as the representative channel value) of the weight basis found from the volumetric distribution was found.

In the first aspect, the magnetic toner should exhibit a magnetization of 10 to 25 emu/g, and preferably 15 to 20 emu/g, in a 5-kiloersted magnetic field. Also, the magnetic toner should exhibit a magnetization of 7 to 20 emu/g, and preferably 10 to 17 emu/g, in a 1-kiloersted magnetic field.

By adjusting the magnetization in the magnetic toner to within the numerical ranges noted above, particularly when a developing apparatus of small size is used, the fluidity of the magnetic toner becomes good, and toner uptake can be effected efficiently and stably by the action of the developer. Accordingly, even when an image that consumes much toner is repeatedly copied, image density decline and image density irregularity are appropriately prevented, Also, the toner scattering and toner development in the texture portions associated with the rotation of the developer carrier due to the magnetic flux forces directed toward the developer carrier due to the magnetization of the toner itself are effectively prevented. Developer is also prevented from separating from the developing sleeve and adhering to the photoconductor. Furthermore, by reducing the particle diameter of the carrier configuring the developer contributing to development, the toner holding rate can be made high, in which sufficient image density and fine line reproducibility can be achieved even in a high-speed copier.

In the second aspect and in the third aspect, the magnetic toner should exhibit magnetization of 10 to 25 emu/g, and preferably 15 to 20 emu/g, in a 5-kiloersted magnetic field. In the third aspect, moreover, the magnetic toner should exhibit magnetization of 10 to 80 emu/g, and preferably 25 to 60 emu/g, in a 1-kiloersted magnetic field.

By controlling the magnetization in the magnetic toners to the numerical ranges noted above, at the time of toner uptake, the developer can take up the toner with good efficiency. Accordingly, even when an image that consumes much toner is repeatedly copied, image density decline and image density irregularity are appropriately prevented. Also, the toner scattering and toner development in the texture portions associated with the rotation of the developer carrier due to the magnetic flux forces directed toward the developer carrier due to the magnetization of the toner itself are effectively prevented. Developer is also prevented from separating from the developing sleeve and adhering to the photoconductor. Furthermore, by reducing the particle diameter of the carrier configuring the developer contributing to development, the toner holding rate can be made high, in which sufficient image density and fine line reproducibility can be achieved even in a high-speed copier.

In the second aspect, in the interest of obtaining good images excelling in fine line and intermediate tone reproducibility, the magnetic toner should contain 2 vol. % or more of magnetic toner particles having a particle diameter of 12.7 $\mu$m or greater.

Magnetic Toner Classifying Method

There is no particular limitation oh the method of classifying the magnetic toner, but a citable method would be one that at least classifies the toner powder raw material into a coarse powder region, medium powder region, and fine powder region, by the inertia of the toner particles in an air flow and/or the centrifugal force of a curved air flow based on the Coanda effect. By such a method, magnetic toner having the particle diameter distributions noted earlier can be efficiently obtained.

Magnetic Toner Composition

The magnetic toner, as described earlier, contains a binding resin and a magnetic particle, and, as necessary, can have other components mixed in appropriately.

Binding Resin

There is no particular limitation on the binding resin, and commonly known resins have been widely used conventionally. Examples of such binding resins include monopolymers of styrenes and their substituents such as polystyrenes, poly-p-chlorostyrenes, and polyvinyl toluene; styrene based copolymers such as styrene-P-chlorostyrene copolymers, styrene-propylene copolymers, styrene-vinyl toluene copolymers, styrene-vinyl naphthalene copolymers, styrene-acrylic acid ester copolymers, styrene-methacrylic acid ester copolymers, styrene-acrylonitrile copolymers, styrene-vinyl methyl ether copolymers, styrene-vinyl ethyl ether copolymers, styrene vinyl methyl ketone copolymers, styrene-butadiene copolymers, styrene-isoprene copolymers, and styrene-acrylonitrile-indene copolymers; and acrylic resins, methacrylic resins, polyvinyl chlorides, polyvinyl acetates, polyethylenes, polypropylenes, polyester resins, polyvinyl butyrals, polyacrylic acid resins, rosins, denatured rosins, terpene resins, phenol resins, natural resin denatured phenol resins, natural resin denatured maleic acid resins, polyurethanes, polyamide resins, furan resins, epoxy resins, cumarone-indene resins, silicon resins, fatty or alicyclic hydrocarbon resins, and aromatic petroleum resins. One type of such resins may be used alone, or two or more types may be used together. Among these, in the interest of developing characteristics and fixing characteristics and the like, the styrene copolymers and polyester resins are to be preferred.

Among the binding resin, examples of co-monomers with respect to styrene monomers of the styrene copolymers include monocarboxylic acids or their substituents having a double bond, such as acrylic acids, methyl acrylate, ethyle acrylate, butyl acrylate, dodecyl acrylate, octyl acrylate, ethylhexyl-2-acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids and their substituents having a double bond, such as maleic acid, butyl maleate, methyl maleate, and dimethyl maleate; vinyl esters such as vinyl chloride, vinyl acetate, and vinyl benzoate; ethylene olefins such as ethylene, propylene, and butylene; vinyl ketones such as vinyl methyl ketone and vinyl hexyl ketone; and vinyl ethers such as vinyl ethyl ether and vinyl isobutyl ether. One type of such monomers may be used alone, or two or more types may be used together.

Of the binding resins, the polyester resins noted above can be manufactured by a commonly known synthesis process using an alcohol component and an acid component.

Examples of the alcohol component include such diols as polyethylene glycol, diethylene glycol, triethylene glycol 1,2-propylene glycol, 1,3-propylene glycol, 1,4-propylene glycol, neopentyl glycol, and 1,4-butene diol, etherized bisphenols such as 1,4-bis(hydroxymethyl) cyclohexane, visphenol A, hydrogen-added bisphenol A, polyoxyethylenized bisphenol A, and polyoxypropylenized bisphenol A, bivalent alcohols wherein those are substituted for by a saturated or unsaturated hydrocarbon group having 3 to 22 carbons, together with simple bivalent alcohols wherein those are substituted for by a saturated or unsaturated hydrocarbon group, other simple bivalent alcohols, and polyvalent alcohol monomers, having a valence of 3 or greater, such as sorbitol, 1,2,3,6-hexane tetrol, 1,4-sorbitan, pentaerythritol, dipentaerythritol, tripentaerythritol, sucrose, 1,2,4-butane triol, 1,2,5-pentatriol, glycerol, 2-methylpropane triol, 2-methyl-1,2,4butane triol, trimethylol ethane, trimethylol propane, and 1,3,5-trihydroxymethyl benzene. One type of such alcohol components may be used alone, or two or more types may be used together.

Examples of the acid component include such monocarboxylic acids as palmitic acid, stearic acid, oleic acid, as well as maleic acid, fumaric acid, mesaconic acid, citraconic acid, itaconic acid, glutaconic acid, phthalic acid, isophthalic acid, terephthalic acid, cyclohexane dicarboxylic acid, succinic acid, adipic acid, sebacic acid, malonic acid, bivalent organic acid monomers wherein those are substituted for by a saturated or unsaturated hydrocarbon group having 3 to 22 carbons, anhydrides of these acids, dimers of low-class alkyl ester trinoleic acid, other bivalent organic acid monomers, 1,2,4-benzene tricarboxylic acid, 1,2,5-benzene tricarboxylic acid, 1,2,4-cyclohexane tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, tetra(methylene carboxyl)methane, 1,2,7,8-octane tetracarboxyl acid enbol trimer acid, and anhydrides of these acid components or other polyvalent carboxylic acid monomers, having a valence of 3 or greater, and the like. One type of such acid components may be used alone, or two or more types may be used together.

Magnetic Particle

For magnetic bodies contained in the magnetic toner, examples include iron oxides such as magnetite, hematite, and ferrite, such metals as iron, cobalt, and nickel, as well as alloys or mixtures of those metals with such metals as cobalt, iron, lead, magnesium, tin, zinc, antimony, beryllium, bismuth, cadmium, calcium, manganese, selenium, titanium, tungsten, and vanadium. One type of such materials may be used alone, or two or more types may be used together. Among these, magnetite is particularly preferable.

There is no particular limitation on the method by which such magnetite is manufactured, and manufacture may be done by a commonly known manufacturing process. For example, an aqueous solution of iron sulfate may be neutralized with an alkaline aqueous solution to obtain iron hydroxide. Then a liquid suspension of the iron hydroxide, with pH adjusted to 10 or higher, is oxidized with a gas containing oxygen to yield a magnetite slurry. That slurry is then washed with water, filtered, dried, and shredded. Thusly can magnetite particles be manufactured.

The mean particle diameter of the magnetic particle, in terms of weight-average particle diameter, should be 0.01 to 1 $\mu$m, with 0.1 to 0.5 $\mu$m being preferable. The amount of such magnetic particle contained in the magnetic toner should be 5 to 80 mass percent, and preferably 10 to 60 mass percent.

The FeO content in the magnetic particle should be 5 to 50 mass percent, and preferably 10 to 30 mass percent. The specific surface area of the magnetic particle should be 1 to 60 $m^2/g$, and preferably 3 to 20 $m^2/g$.

Other Components

Examples of other components which may be mixed into the magnetic toner includes colorants such as pigments or dyes, mold releasing agents, charge controlling agents, polarity controlling agents, fluidity imparting agents, and hydrophobic treatment agents.

Examples of such pigments include the following.

Such black pigments as carbon black, oil furnace black, channel black, lamp black, acetylene black, aniline black and other azine colorants, metal salt azo dyestuffs, metal oxides, and complex metal oxides may be cited.

Examples of yellow pigments that may be cited include cadmium yellow, mineral fast yellow, nickel titanium yellow, naples yellow, naphthol yellow-S, hansa yellow-G, hansa yellow-10G, benzidine yellow-GR, quinoline yellow lake, permanent yellow-NCG, and tartrazine lake.

Examples of orange pigments that may be cited include molybdenum orange, permanent orange GTR, pyrazolone orange, vulcan orange, indanthren brilliant orange RK, benzidine orange G, and indanthren brilliant orange GK and the like may be cited.

Examples of red pigments that may be cited include iron oxide red, cadmium red, permanent red 4R, lithol red, pyrazolone red, watching red cadmium salts, lake red D, brilliant carmine 6B, eosine lake, rhodamine lake B, alizarin lake, and brilliant carmine 3B.

Examples of violet pigments that may be cited include fast violet B and methyl violet lake.

Examples of blue pigments that may be cited include cobalt blue, alkali blue, victorian blue lake, phthalocyanine blue, non-metallic phthalocyanine blue, partially chlorinated phthalocyanine blue, fast sky blue, and indanthren blue BC.

Examples of green pigments that may be cited include chrome green, chrome oxide, pigment green B, and malachite green lake.

There is no particular limitation on the dyes mentioned above, and all commonly known dyes used in ordinary developers are suitable for use for instance, chrome containing azo dye.

One type of these colorants may be used alone, or two or more types may be used together.

The mold release agents mentioned above can be suitably added internally into the magnetic toner for the purpose of preventing offsetting when fixing.

Examples of such mold release agents include such natural waxes as candelilla wax, carnauba wax, and rice wax, and also montan wax, paraffin wax, SASOL wax, low molecular-weight polyethylenes, low molecular-weight polypropylenes, and alkylenic acid esters and the like. These can be selected suitably according to the binding resin and fixing roller surface material and the like.

The melting point of the mold release agent should be 65 to 90° C.

When the melting point is lower than 65° C., blocking sometimes tends to occur when the magnetic toner is stored. When 90° C. is exceeded, on the other hand, offsetting sometimes tends to occur in low temperature regions of the fixing roller.

The charge controlling agent noted earlier may be used added internally into the magnetic toner, or added externally thereto. By using this charge controlling agent, it becomes possible to effect optimal charge amount control according to the developing system. This is particularly effective in cases where a developing scheme is adopted that does not control toner density.

There is no particular limitation on the polarity controlling agents mentioned earlier, and all conventionally known positive polarity controlling agents and negative polarity controlling agents can be used suitably.

Examples of the such positive polarity controlling agents include denatured substances made from nigrosine and a fatty acid metal salt or the like; quaternary ammonium salts such as tributylbenzyl ammonium-1-hydroxy-4-naphthosulfonic acid and tetrabutyl ammonium tetrafluoroborate; diorgano tin oxides such as dibutyl tin oxide, dioctyl tin oxide, and dicyclohexyl tin oxide, and diorgano tin borates such as dibutyl tin borate, dioctyl tin borate, and dicyclohexyl tin borate. One type of such agents may be used alone, or two or more types may be used together, Of these, such polarity controlling agents as nigrosine compounds and organic quaternary ammonium salts and the like are particularly to be preferred.

Examples of the negative polarity controlling agents that may be cited include organic metal compounds and chelated compounds and the like. Examples thereof include aluminum acetyl acetate, ferrous (II) acetyl acetate, and 3,5-di-t-butyl chromium salicylate. Of these, acetyl acetone metal complexes, monoazo metal complexes, naphthoic acid, or, alternatively, salicylic acid based metal complexes and salts and the like are to be preferred, but especially salicylic acid based metal complexes, monoazo metal complexes, and salicylic acid based metal salts.

It is preferable that the polarity control agents be used in a fine granular form, with fine powders having a number-average particle diameter of 3 $\mu$m or less being specifically to be preferred.

The amount of the polarity controlling agent to mix in is determined according to such factors as the type of binding resin, whether or not additives are used, according to necessity, and the toner manufacturing method inclusive of the dispersion method, and hence cannot be defined univocally. Nevertheless, that amount should be 0.1 to 20 parts by mass, and preferably 0.2 to 10 parts by mass, to 100 parts by mass of the binding resin.

When the amount mixed in is less than 0.1 parts by mass, the amount of toner charging is insufficient, so that is not practical, whereas, when 20 parts by mass is exceeded, the amount of toner charging is too large, and the electrostatic pulling force with the carrier increases, sometimes leading to a decline in developer fluidity and/or decline in image density.

Examples of fluidity imparting agents that may be cited include oxides or complex oxides of Si, Ti, Al, Mg, Ca, Sr, Ba, In, Ga, Ni, Mn, W, Fe, Co, Zn, Cr, Mo, Cu, Ag, V, and Zr. One type of such agents may be used alone, or two or more types may be used together. Of these, silicon dioxide (silica), titanium dioxide (titania), and alumina fine powders are to be preferred. Of these, moreover, those having a primary particle diameter of 0.1 μm or less are to be preferred. Of these fluidity imparting agents, if hydrophobic silicon fine particles measuring 0.05 μm or less and hydrophobic titanium oxide fine particles measuring 0.05 μm or less are used together, a two-component developer is provided that exhibits extremely outstanding environmental stability and image density stability.

The amount of such fluidity imparting agent mixed in should be 0.1 to 2 mass percent relative to the magnetic toner.

When the amount mixed in is less than 0.1 mass percent, the effectiveness in correcting toner agglutination is sometimes weak, whereas when 2 mass percent is exceeded, such problems as toner scattering between fine lines, contamination of the interior of the machine, and the photoconductor being marred or worn tend to arise.

In the two-component developer of the present invention, furthermore, even if the amount of the fluidity imparting agent added is small, such effectiveness is achieved as that prescribed fluidity is secured, and, even when many sheets are copied or printed over a prolonged period, high-resolution image quality is maintained. The effectiveness of the present invention is clearly more effective than when a developer is used wherein the amount of toner having a particle diameter of 5 μm or less is made great and a large amount of a fluidity imparting agent has been added.

The hydrophobic treatment agents noted earlier are effective for surface improvement treatment. Examples of such hydrophobic treatment agents include dimethyldichlorosilane, trimethylchlorosilane, methyltrichlorosilane, allyldimethyldichlorosilane, ariruphenyldichlorosilane, benzyldimethylchlorosilane, bromomethytdimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinylmethoxysilane, vinyl-tris (β-methoxyethoxy) silane, γ-methacryloxypropyltriraethoxysilane, vinyltriacetoxysilane, divinyldichlorosilane, dimethylvinylchlorosilane, octyl-trichlorosilane, decyl-trichlorosilane, nonyl-trichlorosilane, (4-t-propylphenyl)-trichlorosilane, (4-t-butylphenyl)-trichhrorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, dioctyl-dichlorosilane, didecinyl-dichlorosilane, dinonenyl-dichlorosilane, di-2-ethylbexyl-dichlorosilane, di-3,3-dimethylpentyl-dichlorosilane, trthexyl-chlorosilane, trioctyl-chlorosilane, tridecyl-chlorosilane, dioctyl-methyl-chlorosilane, octyl-methyl-chlorosilane, (4-t-propylphenyl)-diethyl-chlorosilane, octyltrimethoxysilane, hexamethyldisilazane, hexaethyldisilazane, diethyl tetramethyl disilazane, hexaphenyl disilazane, and hexatolyl disilazane. Besides those, titanate based coupling agents and aluminum based coupling agents and the like can also be used as the hydrophobic treatment agent.

Magnetic Carrier

There is no particular limitation on the magnetic carrier noted earlier, and conventionally known substances can be used, with examples including such magnetic particles as iron powder, ferrite powder, nickel powder, and magnetite powder, such magnetic particles the surface whereof has been treated with a resin, and magnetic particle dispersion resin particles wherein magnetic particles are dispersed in a resin.

For the magnetic carrier, those are preferable that have a coating layer formed of various substances. Examples of substances for forming such coating layer include polyolefin resins such as polyethylenes, polypropylenes, polyethylene chlorides, and sulfonated polyethylenes; polyvinyl or polyvinylidene resins such as polystyrenes, acrylates (like polymethylmethacrylates, for example), polyacryl nitriles, polyvinyl acetates, polyvinyl alcohols, polyvinyl butyrals, polyvinyl chlorides, polyvinyl carbazoles, polyvinyl ethers, and polyvinyl ketones; fluorine based resins such as vinyl chloride-vinyl acetate copolymers, polytetratluoroethylenes, polyvinyl fluorides, polyvinylidene fluorides, and polychlorotrifluoroethylenes; polyamides; polyesters; polyurethanes; polycarbonates; amino resins such as urea-formaldehyde resins; epoxy resins; and silicone resins.

Of these substances, the silicone resins, or silicone resins containing carbon black, or the like, are preferable because they are the most outstanding in resisting the spent phenomenon.

There is no particular limitation on such silicone resins, and any conventionally known silicone resin may be used suitably. Examples include straight silicones formed only of organo-siloxane bonds, as shown below in formulas 1 and 2, and silicone resins which have been denatured with an alkyd, polyester, epoxy, or urethane or the like.

Formula 1

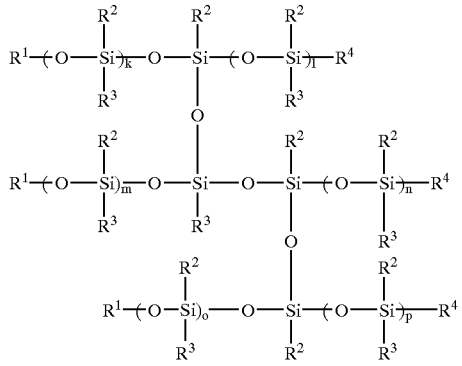

In formula 1, $R^1$ is either one or other of a hydrogen or an alkyl group and phenyl group having 1 to 4 carbons, $R^2$ and $R^3$ are, respectively, one or other of a hydrogen group, alcoxy group having 1 to 4 carbons phenyl group, phenoxy group, alkenyl group having 2 to 4 carbons, alkenyloxy group having 2 to 4 carbons, hydroxy group, carboxyl group, ethylene oxide group, glycidyl group, or group expressed by the following formula. $R^5$ is one or other of a hydroxy group, carboxyl group, alkyl group having 1 to 4 carbons, alcoxy group having 1 to 4 carbons, alkenyl group having 2 to 4 carbons, alkenyloxy group having 2 to 4 carbons, phenyl group, or phenoxy group. The symbols k, l, m, n, o, and p represent integers 1 or greater.

Formula 2

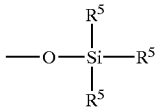

In formula 2, $R^5$ is the same as $R^4$ in formula 1.

In formulas 1 and 2, the substituent groups $R^1$ to $R^5$ may, besides being those which are not substituted, have such substituent groups as, for example, the amino group, hydroxy group, carboxyl group, mercapto group, alkyl group, phenyl group, ethylene oxide group, glycidyl group, and halogen group.

Furthermore, by mixing carbon black into the coating layer of the magnetic carrier, the desired carrier electrical resistance is appropriately obtained.

For the carbon black mentioned here, any carbon black may be used, such as furnace black, acetylene black, or channel black. Of these, by using a mixture of furnace black and acetylene black, in particular, it is possible to effectively regulate electrical conductivity with a small amount of additive, and carriers exhibiting outstanding wear-resistance in the coating layer are obtained.

The carbon black should have a particle diameter of 0.01 to 10 $\mu$m or so. It is further preferable that 2 to 30 parts by mass of such carbon blacks be added to 100 parts by mass of the material (resin or the like) used in the coating layer, with the addition of 5 to 20 parts by mass being even more preferable.

A coupling agent such as a silane coupling agent or titanium coupling agent may also be added to the coating layer for the purpose of enhancing adhesion with nuclide particles or enhancing the dispersion characteristics of the electroconductivity imparting agent.

Examples of such silane coupling agents are compounds expressed by the general formula below.

General Formula $$YRSiX_3$$

In the general equation above, X is a hydrolyzable group bonded to a silicon atom, being a chloro group, alcoxy group, acetoxy group, alkylamino group, and propenoxy group or the like. Y is an organic functional group that reacts with an organic matrix, being a vinyl group, methacryl group, epoxy group, glycidoxy group, amino group, and mercapto group or the like. R is either an alkylene group or alkyl group having 1 to 20 carbons.

Of the silane coupling agents, an aminosilane coupling agent having an amino group in Y, in the general formula above, is preferable in order to obtain a developer having negative charging properties, while an epoxysilane coupling agent having an epoxy group in Y is preferable in order to obtain a developer having positive charging properties.

There is no particular limitation on the method of forming the coating layer, and any conventional method may be suitably used. A citable example would be a method whereby a coating layer forming liquid is applied by a spray method, immersion method, or other coating method to the surface of the carrier nuclide particles.

The thickness of the coating layer should be 0.1 to 20 $\mu$m.

The mean particle diameter of the magnetic carrier should be 35 to 80 $\mu$m. The mean particle diameter of the magnetic carrier can be measured by various methods, but, in the present invention, a method such as one based on ordinary screening, or one based on analysis by an image processing and analyzing apparatus of 200 to 400 particles randomly extracted from images obtained by an optical microscope, can be used.

When the two-component developer of the present invention is used as a color developer, it should combine the magnetic toner described earlier, and a magnetic carrier having a coating layer containing a silicone resin, exhibiting an average particle diameter of 35 to 80 $\mu$m. By such a combination as this, the useful life of the developer can be dramatically improved.

Other Components Contained in Two-component Developer

In the two-component developer of the present invention, it is also possible to use small amounts of such lubricating agents as Teflon powder, zinc stearate powder, or vinylidene polyfluoride powder; such polishing agents as selenium oxide powder, silicon carbide powder, or strontium titanate powder; such electroconductivity imparting agents as carbon black powder, zinc oxide powder, and tin oxide powder, as well as reverse polarity fine white particles and fine black particles or the like, as agents for enhancing the developing characteristics, within such range as will not have a substantively adverse effect.

Two-component Developer Manufacturing Method, etc.

There is no particular limitation of the method of manufacturing the two-component developer of the present invention, and any commonly known method may be appropriately used, including, for example, the method described below.

First, the binding resin, pigment or dye used as the colorant, charge controlling agent, lubricating agent, and other kinds of additives and the like, described in the foregoing, are thoroughly mixed using a mixing machine such as a Henschel mixer. After mixing, the configuring materials are kneaded well, using a batch-type double roller, Banbury mixer, or a continuous double-axis extruder (such, for example, as the model KTK double-axis extruder manufactured by Kobe Steel, Ltd., the model TEM double-axis extruder manufactured by Toshiba Machine Co., Ltd., the double-axis extruder manufactured by KCK, the model PCM double-axis extruder manufactured by Ikegai Corporation, or the model KEX double-axis extruder manufactured by Kurimoto, Ltd.), or a heating kneading machine such as a continuous single-axis extruder (such, for example, as the Ko-Kneader manufactured by Buss). The material is thereupon cooled, and then coarsely pulverized using a hammer mill to yield a coarsely pulverized material. Here, in the case of a color toner, for the purpose of enhancing the dispersion characteristics of the pigment, the general practice is to use a master batch for the colorant, obtained by dissolving and kneading some of the binding resin and the pigment beforehand.

Next, the coarse pulverized material so obtained is finely pulverized using a fine pulverizing machine wherein a jet air flow is used and/or a mechanical fine pulverizing mill, that is, either using one or the other separately or using both together, to obtain finely pulverized particles. The finely pulverized particles so obtained are then classified into prescribed granularities using a revolving classifier or a classifier that uses the Coanda effect to obtain classified material. Here, in order to obtain magnetic toner having the particle diameter distribution described earlier, of these classifiers, use of a classifier that uses the Coanda effect is to be preferred. The classified material so obtained is thoroughly mixed with a fluidity imparting agent, using a Henschel mixer or the like, and then passed through a screen of 250 mesh or greater, thus removing the large coarse particles and agglutinated particles and yielding the two-component developer of the present invention.

Image Forming Apparatus and Image Forming Method

The image forming apparatus of the present invention comprises a latent image carrier, charging means for charging the latent image carrier, exposing means for exposing a light imagewisely on the latent image carrier charged by the charging means, and forming a latent electrostatic image, developing means for developing the latent electrostatic image using a two-component developer of the present invention, and making the latent electrostatic image visible and forming a developed image, and transfer means for transferring the developed image to a recording medium.

The developing means constitute an image forming apparatus comprising a developer carrier capable of carrying the two-component developer on the surface thereof and having, internally therein, magnetic field generation means, and a layer thickness controlling member for evenly controlling the thickness of the two-component developer carried on the developer carrier.

The image forming method of the present invention is an image forming method for carrying the two-component developer of the present invention in the image forming apparatus of the present invention and forming images, being an image forming method that electrifies a latent image carrier, performs light exposure, in the image pattern, and forms a latent electrostatic image, supplies a two-component developer to the latent electrostatic image, from a developing apparatus comprising a developer carrier capable of carrying the two-component developer on the surface thereof and having magnetic field generation means internally therein and a layer thickness controlling member for evenly controlling the thickness of the two-component developer carried on the developer carrier, makes the latent electrostatic image visible and forms a developed image, and transfers that developed image to a recording medium.

FIG. 1 is a schematic view of a developing apparatus in an image forming apparatus, for describing one embodiment aspect of the image forming apparatus and image forming method of the present invention.

A developing apparatus 13 deployed at the side of a photoconductor drum 1 that is the latent image carrier has a supporting case 14, developing sleeve 15 for the developer carrier, developer accommodating member 16, and first doctor blade 17 as a first layer thickness controlling member, and the like.

The supporting case 14, which has an opening on the side of the photoconductor drum 1, forms a toner hopper 19 as a toner accommodating unit for accommodating magnetic toner 18 internally therein. The toner hopper 19, which is adjacent to the developer accommodating member 16, is a unit that supplies the magnetic toner 18 to the developing sleeve 15. On the side closest to the photoconductor drum 1 of the developer accommodating member 16, the developer accommodating member 16 that forms a developer accommodation unit 16*a* for accommodating the two-component developer 22 containing the magnetic toner 18 and a magnetic carrier is provided integrally with the supporting case 14. In the supporting case 14 positioned below the developer accommodating member 16, moreover, a projection 14*a* having an opposing surface 14*b* is formed, and, by the space between the lower part of the developer accommodating member 16 and the opposing surface 14*b*, a toner supply opening 20 is formed for supplying the magnetic toner 18.

Inside the toner hopper 19, a toner agitator 21 is deployed as toner supply means, which toner agitator 21 is turned by drive means (not shown). The toner agitator 21 feeds the magnetic toner 18 in the toner hopper 19, while stirring it, toward the toner supply opening 20. On the side of the toner hopper 19 opposite that which opposes the photoconductor drum 1 are deployed toner depletion detection means 14*c* for detecting that only a small volume of magnetic toner 18 remains in the toner hopper 19 when that is the case.

The developing sleeve 15 is deployed in the space between the photoconductor drum 1 and the toner hopper 19. The developing sleeve 15 is driven by drive means (not shown) to turn in the direction indicated by the arrow in the diagram, is capable of carrying the two-component developer 22 on the surface thereof, and has a magnet or magnets (not shown) as magnetic field generation means deployed internally therein such that the position thereof relative to the developing apparatus 13 does not change.

On the side of the developer accommodating member 16 opposite to the side thereof attached to the supporting case 14 is integrally attached the first doctor blade 17. The first doctor blade 17, deployed so that a constant gap is maintained between the tip thereof and the outer circumferential surface of the developing sleeve 15, restricts the thickness of the two-component developer 22 carried on the developing sleeve 15 to a predetermined value. The developer accommodating member 16 accommodates excessive two-component developer 22 that is scraped off by the layer thickness restriction imposed by the first doctor blade 17.

In the developer accommodating member 16, at a site positioned near the toner supply opening 20, a second doctor blade 23 is deployed as a second layer thickness controlling member. The second doctor blade 23 restricts the thickness of the two-component developer 22 carried on the developing sleeve 15 to a predetermined value. The base end thereof is attached integrally to the developer accommodating member 16 so that the free end thereof is oriented in a direction that will impede the flow of the layer of the two-component developer 22 formed on the surface of the developing sleeve 15, that is, so that the free end is oriented toward the center of the developing sleeve 15, in order that the free end thereof maintain a constant gap with the outer circumferential surface of the developing sleeve 15. The developer accommodation unit 16*a* is configured so that it has sufficient space to cause the two-component developer 22 to move so as to circulate, within the range affected by the magnetic force of the developing sleeve 15.

The opposing surface 14*b* is formed across a prescribed length, so as to incline downward, from the toner hopper 19 side toward the developing sleeve 15 side. Thereby, when vibration occurs, or irregularities occur in the magnetic force distribution of the magnet or magnets (not shown) deployed inside the developing sleeve 15, or there is a partial toner concentration rise in the two-component developer 22, or the like, even if the carrier drops down into the developer accommodation unit 16*a* from between the second doctor blade 23 and the circumferential surface of the developing sleeve 15, the dropping carrier will be received by the opposing surface 14*b* and moved to the developing sleeve 15 side, magnetically attached to the developing sleeve 15 by magnetic force, and again be supplied inside the developer accommodation unit 16*a*. Thus the quantity of carrier inside the developer accommodation unit 16*a* can be prevented from decreasing, and the development of irregularities in image density in the axial direction of the developing sleeve 15 during image formation can be prevented. The angle of inclination $\alpha$ of the opposing surface 14*b* should be 5° or so, while the prescribed length p should be 2 to 20 mm and preferably 3 to 10 mm or so.

Based on the configuration described above, the magnetic toner 18 that is fed out by the toner agitator 21 from the interior of the toner hopper 19 is supplied through the toner supply opening 20 to the two-component developer 22 carried on the developing sleeve 15, and transported to the developer accommodation unit 16*a*. The two-component developer 22 inside the developer accommodation unit 16*a* is carried by the developing sleeve 15, and conveyed to a position opposing the outer circumferential surface of the photoconductor drum 1, and a developed image is formed on the photoconductor drum 1 by the magnetic toner 18 only bonding electrostatically with the latent electrostatic image formed on the photoconductor drum 1.

Figure 2:
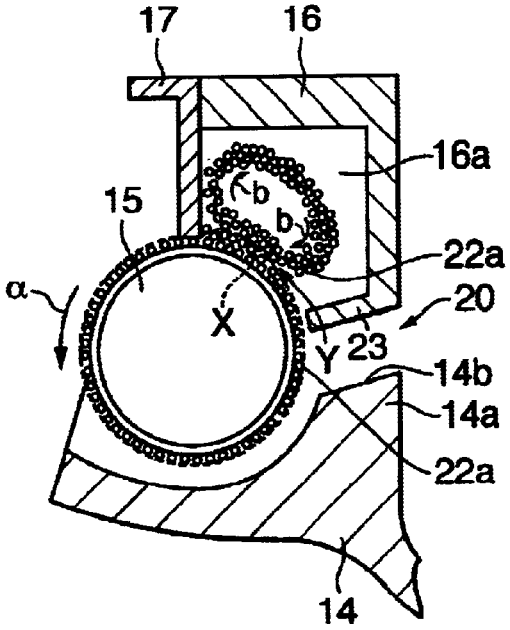
FIG. 2 is a schematic view for describing the behavior of a two-component developer in one embodiment aspect of the image forming apparatus and image forming method of the present invention.

The behavior of the two-component developer 22 during the formation of the developed image is here described. As shown in FIG. 2 (also disclosed in Japanese Patent Application Laid-Open No. H9-197833/1997 (published)), when a starter consisting only of magnetic carrier 22*a* is set in the developing apparatus 13, that magnetic carrier 22*a* is divided into that which is magnetically attached to the surface of the developing sleeve 15 and that which is accommodated inside the developer accommodation unit 16*a*. The magnetic carrier 22*a* accommodated inside the developer accommodation unit 16*a* moves in a circulating fashion at a movement speed of 1 mm/s or greater toward the direction indicated by the arrow b due to the magnetic force from inside the developing sleeve 15, in conjunction with the rotation of the developing sleeve 15 in the direction indicated by the arrow a. Also, an interface X is formed at the interface between the surface of the magnetic carrier 22*a* magnetically attached to the surface of the developing sleeve 15 and the surface of the magnetic carrier 22*a* moving inside the developer accommodation unit 16*a*.

Next, when the magnetic toner 18 is set in the toner hopper 19, magnetic toner 18 is supplied from the toner supply opening 20 to the magnetic carrier 22*a* carried on the developing sleeve 15. Accordingly, the developing sleeve 15 will be carrying the two-component developer 22 which is a mixture of the magnetic toner 18 and the magnetic carrier 22*a*.

Inside the developer accommodation unit 16*a*, due to the presence of the two-component developer 22 accommodated therein, a force acts to stop the conveyance of the two-component developer 22 that is being conveyed by the developing sleeve 15. Also, when the magnetic toner 18 present on the surface of the two-component developer 22 carried by the developing sleeve 15 is conveyed to the interface X, the frictional forces between the two component developer 22 particles near the interface X decline, the conveying force on the two-component developer 22 near the interface X declines, and, as a consequence, the amount of two-component developer 22 being conveyed near the interface X is diminished.

Figure 3:
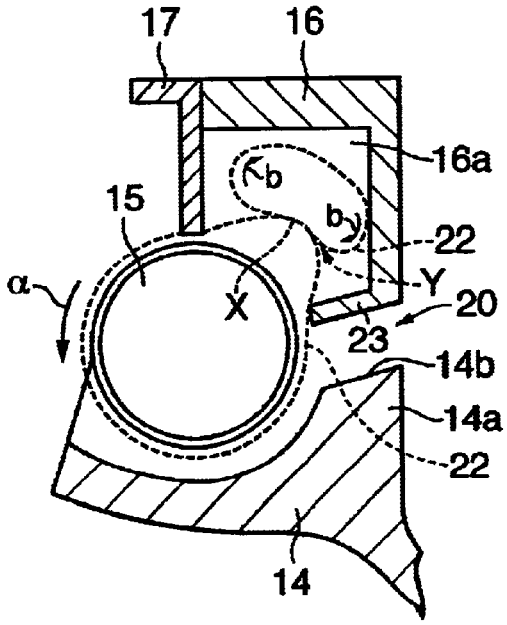
FIG. 3 is a schematic view for describing the behavior of a two-component developer in one embodiment aspect of the image forming apparatus and image forming method of the present invention.

Meanwhile, on the two-component developer 22 that is upstream from the confluence point Y in the direction of the rotation of the developing sleeve 15, no force will act so as to stop the conveyance of the two-component developer 22 being conveyed by the developing sleeve 15, as inside the developer accommodation unit 16*a* as described earlier, such as shown in FIG. 3, the balance between the quantity of the two-component developer 22 conveyed to the confluence point Y and the quantity of the two-component developer 22 conveyed over the interface X will break down, a billiard ball condition will arise in the two-component developer 22, the position of the confluence point Y will rise, and the layer thickness of the two-component developer 22 inclusive of the interface X will increase. The layer thickness of the two-component developer 22 that passed the first doctor blade 17 will gradually increase also, and that increased portion of two-component developer 22 will be scraped off by the second doctor blade 23.

Figure 4:
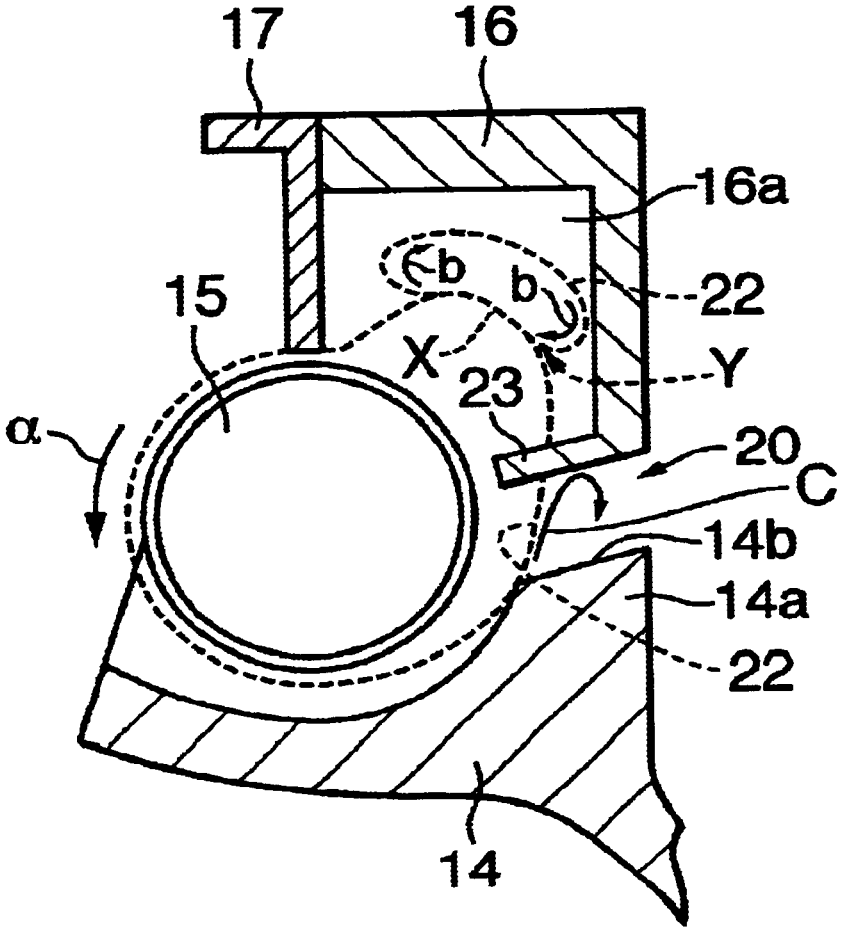
FIG. 4 is a schematic view for describing the behavior of a two-component developer in one embodiment aspect of the image forming apparatus and image forming method of the present invention.

When the two-component developer 22 that passes the first doctor blade 17 reaches the prescribed toner density, as shown in FIG. 4, the increased portion of the two-component developer 22 that was scraped off by the second doctor blade 23 and which became a layer form blocks the toner supply opening 20, and the taking up of the magnetic toner 18 terminates in that condition. At that time, the volume of two-component developer 22 will increase due to the toner density becoming higher inside the developer accommodation unit 16*a*, as a consequence whereof the space inside the developer accommodation unit 16*a* will become narrower, as a result whereof the speed of movement of the two-component developer 22 in moving so as to circulate in the direction indicated by the arrow b in the diagram will decline.

In the layer of the two-component developer 22 formed so that this toner supply opening 20 is blocked, the two-component developer 22 that is scraped off by the second doctor blade 23, as indicated by the arrow c in FIG. 4, moves with a moving speed that is a speed of 1 mm/s or greater and is received by the opposing surface 14*b*. However, because the opposing surface 14*b* is inclined downward with the angle $\alpha$ toward the developing sleeve 15 side and has the prescribed length p, the falling of the two-component developer 22 to the toner hopper 19 by the movement of the two-component developer 22 layer can be prevented, and the quantity of the two-component developer 22 can be maintained always constant, thereby making it possible for the toner supply to be always self-controlled at a constant rate.

The present invention will now be described in detail by means of specific examples, but the invention should not be construed as being limited by the examples in any way.

Embodiments and Comparative Examples in Accordance with the First Aspect

Embodiment A-1

| Compositional Formula | |
|---|---|
| Polyester resin | 100 parts by mass |
| Chrome containing azo dye | 3 parts by mass |
| Magnetite fine particles | 23 parts by mass |
| Polypropylene | 5 parts by mass |

The mixture prepared according to the above compositional formula was mixed by a Henschel mixer, then kneaded with a kneading extruder set for 180° C., cooled and solidified, coarsely pulverized in a cutter mill, and finely pulverized by a mechanical pulverizer to yield finely pulverized material. The finely pulverized material obtained was classified with a multi-segment classifier utilizing Coanda effect, and yielded mother particles in which a weight-average particle diameter is 7.24 $\mu$m and 51.4 No. % of the particles have particle diameters equal to 5 $\mu$m or less. To 100 parts by mass of such mother particles, 0.6 parts by mass of hydrophobic silica having an average particle diameter of 0.3 $\mu$m were added, and mixed with a Henschel mixer to yield a magnetic toner.

The measurement readings of the obtained magnetic toner under magnetic fields of 1 kiloersted and 5 kiloersteds respectively was 12.8 emu/g and 17.1 emu/g

| Compositional Formula | |
|---|---|
| Silicone resin (organo straight silicone) | 100 parts by mass |
| Toluene | 100 parts by mass |
| γ-(2-aminoethyl)aminopropyl trimethoxysilane | 5 parts by mass |
| Carbon black | 10 parts by mass |

Next, the mixture prepared according to the above compositional formula was dispersed for 20 minutes in a Homomixer to prepare a coating layer forming liquid. The coating layer forming liquid was coated on the surface of 1000 parts by mass of spheroid magnetite having a particle diameter of 50 μm, using a fluid bed coating apparatus, and yielded a magnetic carrier A.

90 parts by mass of the carrier A obtained and 10 parts by mass of magnetic toner aforementioned were mixed by a Turbula shaker mixer to yield a two-component developer. The physical properties of the two-component developer obtained are shown in Table 1.

Next, the developing apparatus as shown in FIG. 1 was combined into the imagio MF200 (manufactured by Ricoh Co., Ltd.), and the image density, density irregularity (texture smudging and the like), resolution, and image density controllability of the images at initial copying and after copying 100,000 sheets were measured as below, and durability was evaluated. The results are shown in Table 2.

Tests

Image Density

Image density obtained from the images generated was measured with a Macbeth reflecting densitometer for a total of nine positions, namely, three positions each in the upper, middle, and lower portions thereof.

Density Irregularity

The image density obtained from the images generated was measured with a Macbeth reflecting densitometer for a total of nine positions, namely, three positions each in the upper, middle, and lower portions thereof, and the differences in the maximum and minimum values thereof were defined as density irregularity. Evaluation criteria adopted are as follows.

Evaluation Criteria

◎: difference in image density<0.1

○: difference in image density≧0.1, <0.2

Δ: difference in image density≧0.2, <0.5 x: difference in image density≧0.5

Resolution

Copies were made of line images having vertical and horizontal lines evenly spaced at intervals of 2.0, 2.2, 2.5, 2.8, 3.2, 3.6, 4.0, 4.5, 5.0, 5.6, 6.3, and 7.1 lines per 1 mm, and the reproducibility of the line intervals in the line images of the copied images was evaluated.

Image Density Controllability

A 100% solid image having an original density of 1.6 was continuously copied to make 20 copies, and the change in image density during making 20 copies was evaluated. The evaluation criteria adopted are as follows.

Evaluation Criteria

◎: difference in image density<0.1

○: difference in image density≧0.1, <0.2

Δ: difference in image density≧0.2, <0.5 x: difference in image density≧0.5

Embodiment A-2

To the mother particles obtained in Embodiment A-1, 0.6 parts by mass of hydrophobic silica having an average particle diameter of 0.3 μm and 0.3 parts by mass of hydrophobic titanium oxide were added and mixed with a Henschel mixer to yield magnetic toner.

The measurement readings of the obtained magnetic toner under magnetic fields of 1 kiloersted and 5 kiloersteds respectively was 12.1 emu/g and 17.6 emu/g.

Next, 90 parts by mass of the carrier A obtained in Embodiment A-1 and 10 parts by mass of the magnetic toner were mixed by a Turbula shaker mixer to yield a two-component developer. The physical properties of the two-component developer thus obtained are shown in Table 1.

Tests

Various Evaluations Identical to Embodiment A-1 were Conducted.

Embodiment A-3

Other than altering the classifying conditions to yield mother particles in which a weight-average particle diameter is 7.84 μm and 41.2 No. % of the particles have particle diameters equal to 5 μm or less, magnetic toner and two-component developer were fabricated as in Embodiment A-2, and evaluated as in Embodiment A-2.

The physical properties and evaluation results of the two-component developer obtained are shown in Tables 1 and 2.

Embodiment A-4

Other than altering the classifying conditions to yield mother particles in which a weight-average particle diameter is 6.54 μm and 62.1 No. % of the particles have particle diameters equal to 5 μm or less, magnetic toner and two-component developer were fabricated as in Embodiment A-2, and evaluated as in Embodiment A-2.

The physical properties and evaluation results of the two-component developer obtained are shown in Tables 1 and 2.

Embodiment A-5

Other than altering the classifying conditions to yield mother particles in which a weight-average particle diameter is 6.03 μm and 75.6 No. % of the particles have particle diameters equal to 5 μm or less, magnetic toner and two-component developer were fabricated as in Embodiment A-2, and evaluated as in Embodiment A-2.

The physical properties and evaluation results of the two-component developer obtained are shown in Tables 1 and 2.

Embodiment A-6

| Compositional formula | |
|---|---|
| Polyester resin | 100 parts by mass |
| Chrome containing azo dye | 3 parts by mass |
| Magnetite fine particles | 30 parts by mass |
| Polypropylene | 5 parts by mass |

The mixture prepared according to the above compositional formula was mixed by a Henschel mixer, then kneaded with a kneading extruder set for 180° C., cooled and solidified, coarsely pulverized in a cutter mill, and finely pulverized by a mechanical pulverizer to yield finely pulverized material. The finely pulverized material obtained was classified with a revolving wind-driven classifier, and yielded mother particles in which a weight-average particle diameter is 7.55 μm and 55.7 No. % of the particles have particle diameters equal to 5 μm or less. To 100 parts by mass of such mother particles, 0.5 parts by mass of hydrophobic silica having an average particle diameter of 0.3 μm and 0.3 parts by mass of hydrophobic titanium oxide were added, and mixed with a Henschel mixer to yield a magnetic toner.

Using the magnetic toner thus obtained, and using the same carrier A as in Embodiment A-1, a two-component developer was fabricated, and subjected to various measurements and evaluations as in Embodiment A-1. The results are shown in Tables 1 and 2.

Comparative Example A-1

| Compositional Formula | |
|---|---|
| Polyester resin | 100 parts by mass |
| Chrome containing azo dye | 3 parts by mass |
| Magnetite fine particles | 50 parts by mass |
| Polypropylene | 5 parts by mass |

The mixture prepared according to the above compositional formula was mixed by a Henschel mixer, then kneaded with a kneading extruder set for 180° C., cooled and solidified, coarsely pulverized in a cutter mill, and finely pulverized by a mechanical pulverizer to yield finely pulverized material. The finely pulverized material obtained was classified with a revolving wind-driven classifier, and yielded mother particles in which a weight-average particle diameter is 8.53 μm and 32.3 No. % of the particles have particle diameters equal to 5 μm or less. To 100 parts by mass of such mother particles, 0.5 parts by mass of hydrophobic silica having an average particle diameter of 0.3 μm, and 0.3 parts by mass of hydrophobic titanium oxide were added, and mixed with a Henschel mixer to yield a magnetic toner.

Using the magnetic toner thus obtained, and using the same carrier A as in Embodiment A-1, a two-component developer was fabricated, and subjected to various measurements and evaluations as in Embodiment A-1. The results are shown in Tables 1 and 2.

Comparative Example A-2

| Compositional Formula | |
|---|---|
| Polyester resin | 100 parts by mass |
| Chrome containing azo dye | 3 parts by mass |
| Polypropylene | 5 parts by mass |

The mixture prepared according to the above compositional formula was mixed by a Henschel mixer, then kneaded with a kneading extruder set for 180° C., cooled and solidified, coarsely pulverized in a cutter mill, and finely pulverized by a mechanical pulverizer to yield finely pulverized material. The finely pulverized material obtained was classified with a revolving wind-driven classifier, and yielded mother particles in which a weight-average particle diameter is 5.91 μm and 83.1 No. % of the particles have particle diameters equal to 5 μm or less. To 100 parts by mass of such mother particles, 0.5 parts by mass of hydrophobic silica having an average particle diameter of 0.3 μm and 0.3 parts by mass of hydrophobic titanium oxide were added, and mixed with a Henschel mixer to yield a magnetic toner.

Using the magnetic toner thus obtained, and using the same carrier A as in Embodiment A-1, a two-component developer was fabricated, and subjected to various measurements and evaluations as in Embodiment A-1. The results are shown in Tables 1 and 2.

TABLE 1

| | weight average diameter | *1 | Toner magneti-zation (1 koe) | Toner magneti-zation (5 koe) | composition of carrier coating layer | Fluidity imparting agent |
|---|---|---|---|---|---|---|
| Embodiment A-1 | 7.24 | 51.4 | 12.8 | 17.1 | *3 | Hydrophobic Silica |
| Embodiment A-2 | 7.24 | 51.4 | 12.1 | 17.6 | *3 | *2 |
| Embodiment A-3 | 7.84 | 41.2 | 13.4 | 18.1 | *3 | *2 |
| Embodiment A-4 | 6.54 | 62.1 | 12.2 | 17.3 | *3 | *2 |
| Embodiment A-5 | 6.03 | 75.6 | 11.9 | 16.9 | *3 | *2 |
| Embodiment A-6 | 7.55 | 55.7 | 18.7 | 24.1 | *3 | *2 |
| Comp. Ex. A-1 | 8.53 | 32.3 | 28.9 | 37.6 | *3 | *2 |
| Comp. Ex. A-2 | 5.91 | 83.1 | 0.1 | 0.1 | *3 | *2 |

*1: Number average percent of particles having diameter of 5 μm or less
*2: Hydrophobic silica and hydrophobic titanium oxide
*3: Resin and Carbon Black

TABLE 2

| | initially | | | | after 100,000 copies | | | |
|---|---|---|---|---|---|---|---|---|
| | image density | image irregu-larity | resolu-tion | image density controlla-bility | image density | image irregu-larity | resolu-tion | image density controlla-bility |
| Embodiment A-1 | 1.44 | ◎ | 7.1 | ◎ | 1.41 | ◎ | 6.30 | ○ |
| Embodiment A-2 | 1.41 | ◎ | 7.1 | ◎ | 1.40 | ◎ | 7.10 | ◎ |
| Embodiment A-3 | 1.44 | ◎ | 6.3 | ◎ | 1.41 | ◎ | 5.60 | ◎ |
| Embodiment A-4 | 1.36 | ○ | 7.1 | ○ | 1.31 | ○ | 7.10 | ○ |
| Embodiment A-5 | 1.32 | ○ | 7.1 | ○ | 1.33 | Δ | 7.10 | ○ |
| Embodiment A-6 | 1.28 | ○ | 7.1 | ○ | 1.25 | ○ | 7.10 | ○ |
| Comp. Ex. A-1 | 1.06 | ◎ | 5.6 | ◎ | 0.98 | Δ | 5.60 | ○ |
| Comp. Ex. A-2 | 1.30 | X | 7.1 | X | | | | |

Embodiments and Comparative Examples in Second Aspect

Embodiment B-1

| Compositional Formula | |
|---|---|
| Polyester resin | 100 parts by mass |
| Chrome containing azo dye | 3 parts by mass |
| Magnetite fine particles | 25 parts by mass |
| Polypropylene | 5 parts by mass |

The mixture prepared according to the above compositional formula was mixed by a Henschel mixer, then kneaded with a kneading extruder set for 180° C., cooled and solidified, coarsely pulverized in a cutter mill, and finely pulverized by a mechanical pulverizer to yield finely pulverized material. The finely pulverized material obtained was classified with a multi-segment classifier utilizing Coanda effect, and yielded mother particles in which a weight-average particle diameter is 9.98 μm, 5.2 No. % of the particles have particle diameter of 5 μm or less, 4.8 vol. % of the particles have particle diameter of 12.7 μm or more. To 100 parts by mass of such mother particles, 0.5 parts by mass of hydrophobic silica having an average particle diameter of 0.3 μm was added, and mixed with a Henschel mixer to yield a magnetic toner.

| Compositional Formula | |
|---|---|
| Silicone resin (organo straight silicone) | 100 parts by mass |
| Toluene | 100 parts by mass |
| γ-(2-aminoethyl)aminopropyl trimethoxysilane | 5 parts by mass |
| Carbon black | 10 parts by mass |

The mixture prepared according to above formula was dispersed for 20 minutes in a Homomixer to provide a coating layer forming liquid. The coating layer forming liquid thus obtained was coated onto the surface of 1000 parts by mass of spheroid magnetite having a particle diameter of 50 μm, utilizing a fluid bed coating apparatus, to yield magnetic carrier A.

90 parts by mass of the carrier A obtained and 10 parts by mass of magnetic toner were mixed using a Turbula shaker mixer to yield a two-component developer. The physical properties of the two-component developer obtained are shown in Table 3.

Tests

Using the two-component developer obtained, various evaluations identical to Embodiment A-1 were conducted. The results of evaluation is shown in Table 4.

Embodiment B-2

To the mother particles obtained in Embodiment B-1 0.5 parts by mass of hydrophobic silica having an average particle diameter of 0.3 μm and 0.3 parts by mass of hydrophobic titanium oxide were added, and mixed in a Henschel mixer, to yield a magnetic toner.

90 parts by mass of the carrier A and 10 parts by mass of magnetic toner were mixed using a Turbula shaker mixer to yield a two-component developer. The physical properties of the two-component developer obtained are shown in Table 3.

Tests various evaluations identical to Embodiment A-1 were conducted. The result of evaluation is shown in Table 4.

Embodiment B-3

Other than altering the classifying conditions to yield mother particles in which a weight-average particle diameter is 9.74 μm and 15.2 No. % of the particles have particle diameters equal to 5 μm or less, and 4.3 vol. % of the particles have particle diameters equal to 12.7 μm or greater, magnetic toner and two-component developer were fabricated as in Embodiment B-2, and evaluated as in Embodiment B-2. The results are shown in tables 3 and 4.

Embodiment B-4

Other than altering the classifying conditions to yield mother particles in which a weight-average particle diameter is 8.67 μm and 34.6 No. % of the particles have particle diameters equal to 5 μm or less, and 3.3 vol. % of the particles have particle diameters equal to 12.7 μm or greater, magnetic toner and two-component developer were fabricated as in Embodiment B-2, and evaluated as in Embodiment B-2. The results are shown in tables 3 and 4.

Embodiment B-5

Other than altering the classifying conditions to yield mother particles in which a weight-average particle diameter is 6.79 μm and 58.2 No. % of the particles have particle diameters equal to 5 μm or less, and 2.0 vol, % of the particles have particle diameters equal to 12.7 μm or greater, magnetic toner and two-component developer were fabricated as in Embodiment B-2, and evaluated as in Embodiment B-2. The results are shown in tables 3 and 4.

Embodiment B-6

Other than altering the classifying conditions to yield mother particles in which a weight-average particle diameter is 9.31 μm and 20.1 No. % of the particles have particle diameters equal to 5 μm or less, and 2.7 vol. % of the particles have particle diameters equal to 12.7 μm or greater, magnetic toner and two-component developer were fabricated as in Embodiment B-2, and evaluated as in Embodiment B-2. The results are shown in tables 3 and 4.

Embodiment B-7

| Compositional Formula | |
|---|---|
| Polyester resin | 100 parts by mass |
| Chrome containing azo dye | 3 parts by mass |
| Magnetite fine particles | 30 parts by mass |
| Polypropylene | 5 parts by mass |

The mixture prepared according to the above compositional formula was mixed by a Henschel mixer, then kneaded with a kneading extruder set for 180° C., cooled and solidified, coarsely pulverized in a cutter mill, and finely pulverized by a mechanical pulverizer to yield finely pulverized material. The finely pulverized material obtained was classified with a revolving wind-driven classifier, and yielded mother particles in which a weight-average particle diameter is 8.38 μm and 35.4 No. % of the particles have particle diameters equal to 5 μm or less, and 2.3 vol. % of the particles have particle diameter of 12.7 μm or more. To 100 parts by mass of such mother particles, 0.5 parts by mass of hydrophobic silica having an average particle diameter of 0.3 μm and 0.3 parts by mass of hydrophobic titanium oxide were added, and mixed with a Henschel mixer to yield a magnetic toner.

Using the magnetic toner thus obtained, a two-component developer was fabricated, and subjected to various measurements and evaluations as in Embodiment B-1. The results are shown in Tables 3 and 4.

Comparative Example B-1

| Compositional Formula | |
|---|---|
| Polyester resin | 100 parts by mass |
| Chrome containing azo dye | 3 parts by mass |
| Magnetite fine particles | 50 parts by mass |
| Polypropylene | 5 parts by mass |

The mixture prepared according to the above compositional formula was mixed by a Henschel mixer, then kneaded with a kneading extruder set for 180° C., cooled and solidified, coarsely pulverized in a cutter mill, and finely pulverized by a mechanical pulverizer to yield finely pulverized material. The finely pulverized material obtained was classified with a revolving wind-driven classifier, and yielded mother particles in which a weight-average particle diameter is 8.18 μm and 32.3 No. % of the particles have particle diameters equal to 5 μm or less, and 1.9 vol. % of the particles have particle diameter of 12.7 μm or more. To 100 parts by mass of such mother particles, 0.5 parts by mass of hydrophobic silica having an average particle diameter of 0.3 μm and 0.3 parts by mass of hydrophobic titanium oxide were added, and mixed with a Henschel mixer to yield a magnetic toner. Using the magnetic toner thus obtained, a two-component developer was fabricated, and subjected to various measurements and evaluations as in Embodiment B-1. The results are shown in Tables 3 and 4.

Comparative Example B-2

| Compositional Formula | |
|---|---|
| Polyester resin | 100 parts by mass |
| Chrome containing azo dye | 3 parts by mass |
| Polypropylene | 5 parts by mass |

The mixture prepared according to the above compositional formula was mixed by a Henschel mixer, then kneaded with a kneading extruder set for 180° C., cooled and solidified, coarsely pulverized in a cutter mill, and finely pulverized by a mechanical pulverizer to yield finely pulverized material. The finely pulverized material obtained was classified with a revolving wind-driven classifier, and yielded mother particles in which a weight-average particle diameter is 6.21 μm and 63.2 No. % of the particles have particle diameters equal to 5 μm or less, and 0.0 vol. % of the particles have particle diameter of 12.7 μm or more. To 100 parts by mass of such mother particles, 0.5 parts by mass of hydrophobic silica having an average particle diameter of 0.3 μm and 0.3 parts by mass of hydrophobic titanium oxide were added, and mixed with a Henschel mixer to yield a magnetic toner. Using the magnetic toner thus obtained, a two-component developer was fabricated, and subjected to various measurements and evaluations as in Embodiment B-1. The results are shown in Tables 3 and 4.

TABLE 3

| | weight ave. particle diameter (μm) | *1 | Nnumber percent of 5 μm or less | Toner magnetization (5 köe) | composition of carrier coating layer | Fluidity imparting agent |
|---|---|---|---|---|---|---|
| Embodiment B-1 | 9.98 | 4.8 | 5.2 | 18.1 | *3 | Hydrophobic Silica |
| Embodiment B-2 | 9.98 | 4.6 | 6.1 | 17.7 | *3 | *2 |
| Embodiment B-3 | 9.74 | 4.3 | 15.2 | 17.5 | *3 | *2 |
| Embodiment B-4 | 8.67 | 3.3 | 34.6 | 19.3 | *3 | *2 |
| Embodiment B-5 | 6.79 | 2.0 | 58.2 | 17.6 | *3 | *2 |
| Embodiment B-6 | 9.31 | 2.7 | 20.1 | 18.8 | *3 | *2 |
| Embodiment B-7 | 8.38 | 2.3 | 35.4 | 24.3 | *3 | *2 |
| Comp. Ex. B-1 | 8.18 | 1.9 | 32.3 | 37.6 | *3 | *2 |
| Comp. Ex. B-2 | 6.21 | 0.0 | 63.2 | | *3 | *2 |

*1: volume percent of particles having diameter of 12.7 μm or less

*2: Hydrophobic Silica and hydrophobic titanium oxide

*3: Resin and Carbon Black

TABLE 4

| | initially | | | | after 100,000 copies | | | |
|---|---|---|---|---|---|---|---|---|
| | image density | image irregularity | resolution | image density controllability | image density | image irregularity | resolution | image density controllability |
| Embodiment B-1 | 1.42 | ◎ | 5.6 | ◎ | 1.39 | ◎ | 5.6 | ○ |
| Embodiment B-2 | 1.41 | ◎ | 6.3 | ◎ | 1.33 | ◎ | 5.6 | ○ |
| Embodiment B-3 | 1.40 | ○ | 7.1 | ○ | 1.37 | ○ | 6.3 | ○ |
| Embodiment B-4 | 1.38 | ○ | 7.1 | ○ | 1.31 | ○ | 7.1 | ○ |
| Embodiment B-5 | 1.32 | ○ | 7.1 | ○ | 1.33 | Δ | 7.1 | ○ |
| Embodiment B-6 | 1.44 | ◎ | 7.1 | ◎ | 1.32 | ◎ | 7.1 | ○ |
| Embodiment B-7 | 1.34 | ○ | 7.1 | ○ | 1.31 | ○ | 7.1 | ○ |
| Comp. Ex. B-1 | 1.12 | ◎ | 6.3 | ◎ | 1.01 | Δ | 5.6 | |
| Comp. Ex. B-2 | 1.30 | X | 7.1 | X | | | | |

Embodiments and Comparative Examples According to the Third Aspect

Embodiment C-1

| Compositional Formula | |
|---|---|
| Styrene acrylic resin | 100 parts by mass |
| Chrome containing azo dye | 3 parts by mass |
| Magnetite fine particles | 30 parts by mass |
| Polypropylene | 5 parts by mass |

The mixture prepared according to the above compositional formula was mixed by a Henschel mixer, then kneaded with a kneading extruder set for 180° C., cooled and solidified, coarsely pulverized in a cutter mill, and finely pulverized by a mechanical pulverizer to yield finely pulverized material. The finely pulverized material obtained was classified with a multi-segment classifier utilizing Coanda effect, and yielded mother particles in which a weight-average particle diameter is 9.98 μm, 5.2 No. % of the particles have particle diameters equal to 4 μm or less, a ratio between the number-average particle diameter (D25) and the number-average particle diameter (D75), which is expressed by D25/D75, was 0.71, and 4.3 vol. % of the particles having twice or greater diameter than the weight-average particle diameter. To 100 parts by mass of such mother particles, 0.5 parts by mass of hydrophobic silica having an average particle diameter of 0.3 μm was added, and mixed with a Henschel mixer to yield a magnetic toner.

| Compositional Formula | |
|---|---|
| Silicone resin (organo straight silicone) | 100 parts by mass |
| Toluene | 100 parts by mass |
| Carbon black | 10 parts by mass |

Next, a mixture according to the above formula was dispersed for 20 minutes in a Homomixer and prepared a coating layer forming liquid. The coating layer forming liquid was coated onto the surface of 1000 parts by mass of spheroid magnetite having a particle diameter of 50 μm, utilizing a fluid bed coating apparatus, to yield magnetic carrier B.

80 parts by mass of the carrier B obtained and 20 parts by mass of magnetic toner were mixed in a Turbula shaker mixer to yield a two-component developer. The physical properties of the two-component developer obtained are shown in Table 5.

Tests

Using the two-component developer obtained, the developing apparatus as shown in FIG. 1 was combined into the Spirio 3500 (manufactured by Ricoh Co., Ltd.), and the image density, density irregularity (texture smudging and the like), resolution, and image density controllability of the images at initial copying and after copying 500,000 sheets were measured, and variously evaluated as shown in the <Tests> in Embodiment A-1. The results are shown in Table 6.

Embodiment C-2

| Compositional Formula | |
|---|---|
| Styrene acrylic resin | 100 parts by mass |
| Chrome containing azo dye | 3 parts by mass |
| Magnetite fine particles | 20 parts by mass |
| Polypropylene | 5 parts by mass |

The mixture prepared according to the above compositional formula was mixed by a Henschel mixer, then kneaded with a kneading extruder set for 180° C., cooled and solidified, coarsely pulverized in a cutter mill, and finely pulverized by a mechanical pulverizer to yield finely pulverized material. The finely pulverized material obtained was classified with a multi-segment classifier utilizing Coanda effect, and yielded mother particles in which a weight-average particle diameter is 9.98 μm, 6.2 No. % of the particles have particle diameters equal to 4 μm or less, a ratio between the number-average particle diameter (D25) and the number-average particle diameter (D75), which is expressed by D25/D75, was 0.73, and 3.6 vol, % of the particles having twice or greater diameter than the weight-average particle diameter. To 100 parts by mass of such mother particles, 0.5 parts by mass of hydrophobic silica having an average particle diameter of 0.3 μm was added, and mixed with a Henschel mixer to yield a magnetic toner.

| Compositional Formula | |
|---|---|
| Silicone resin (organo straight silicone) | 100 parts by mass |
| Toluene | 100 parts by mass |
| γ-(2-aminoethyl)aminopropyl trimethoxysilane | 5 parts by mass |
| Carbon black | 10 parts by mass |

Next, a mixture according to the above formula was dispersed for 20 minutes in a Homomixer and prepared a coating layer forming liquid. The coating layer forming liquid was coated onto the surface of 1000 parts by mass of spheroid magnetite having a particle diameter of 50 μm, utilizing a fluid bed coating apparatus, to yield magnetic carrier A.

80 parts by mass of the carrier A obtained and 20 parts by mass of magnetic toner were mixed in a Turbula shaker mixer to yield a two-component developer. The physical properties of the two-component developer obtained are shown in Table 5.

Tests

Using the two-component developer obtained, the developing apparatus as shown in FIG. 1 was combined into the imagio DA 350 (manufactured by Ricoh Co., Ltd.), and the image density, density irregularity (texture smudging and the like), resolution, and image density controllability of the images at initial copying and after copying 500,000 sheets were measured, and variously evaluated as shown in the <Tests> in Embodiment A-1. The results are shown in Table 6.

Embodiment C-3

Other than altering the classifying conditions to yield mother particles in which a weight-average particle diameter is 9.74 μm and 17.1 No. % of the particles have particle diameters equal to 4 μm or less, and a ratio between the number-average particle diameter (D25) and the number-average particle diameter (D75), which is expressed by D25/D75, was 0.68, and 3.1 vol. % of the particles having twice or greater diameter than the weight-average particle diameter, magnetic toner and two-component developer were fabricated as in Embodiment C-2, and evaluated as in Embodiment C-2. The results are shown in tables 5 and 6.

Embodiment C-4

Other than altering the classifying conditions to yield mother particles in which a weight-average particle diameter is 8.67 μm and 34.6 No. % of the particles have particle diameters equal to 4 μm or less, and a ratio between the number-average particle diameter (D25) and the number-average particle diameter (D75), which is expressed by D25/D75, was 0.63, and 3.7 vol. % of the particles having twice or greater diameter than the weight-average particle diameter, magnetic toner and two-component developer were fabricated as in Embodiment C-2, and evaluated as in Embodiment C-2. The results are shown in tables 5 and 6.

Embodiment C-5

Other than altering the classifying conditions to yield mother particles in which a weight-average particle diameter is 6.79 μm and 58.2 No. % of the particles have particle diameters equal to 4 μm or less, and a ratio between the number-average particle diameter (D25) and the number-average particle diameter (D75), which is expressed by D25/D75, was 0.61, and 2.1 vol. % of the particles having twice or greater diameter than the weight-average particle diameter, magnetic toner and two-component developer were fabricated as in Embodiment C-2, and evaluated as in Embodiment C-2. The results are shown in tables 5 and 6.

Embodiment C-6

Other than altering the classifying conditions to yield mother particles in which a weight-average particle diameter is 9.31 μm and 20.1 No. % of the particles have particle diameters equal to 4 μm or less, and a ratio between the number-average particle diameter (D25) and the number-average particle diameter (D75), which is expressed by D25/D75, was 0.72, and 3.2 vol. % of the particles having twice or greater diameter than the weight-average particle diameter, magnetic toner and two-component developer were fabricated as in Embodiment C-2, and evaluated as in Embodiment C-2. The results are shown in tables 5 and 6.

Comparative Example C-1

| Compositional Formula | |
|---|---|
| Styrene acrylic resin | 100 parts by mass |
| Chrome containing azo dye | 3 parts by mass |
| Polypropylene | 5 parts by mass |

The mixture prepared according to above compositional formula was mixed by Henschel mixer, than kneaded with a kneading extruder set for 180° C., cooled and solidified, coarsely pulverized in a cutter mill, and finely pulverized by mechanical pulverizer to yield finely pulverized material. The finely pulverized material obtained was classified with a multi-segment classifier utilizing Co-anda effect, and yielded mother particles in which a weight-average particle diameter is 8.18 μm and 63.2 No. % of the particles have particle diameters equal to 4 μm or less, and a ratio between the number-average particle diameter (D25) and the number-average particle diameter (D75), which is expressed by D25/D75, was 0.57, and 7.1 vol. % of the particles having twice or greater diameter than the weight-average particle diameter, toner and two component developer were fabricated as in Embodiment C-2, and evaluated as in Embodiment C-2. The results are shown in Tables 5 and 6.

Embodiment C-7

Other than using a revolving wind-driven classifier as the classifying apparatus and obtained mother particles in which a weight-average particle diameter is 8.38 μm and 18.4 No. % of the particles have particle diameters equal to 4 μm or less, and a ratio between the number-average particle diameter (D25) and the number-average particle diameter (D75), which is expressed by D25/D75, was 0.66, and 3.7 vol. % of the particles having twice or greater diameter than the weight-average particle diameter, magnetic toner and two-component developer were fabricated as in Embodiment C-2, and evaluated as in Embodiment C-2. The results are shown in tables 5 and 6.

Embodiment C-8

| Compositional Formula | |
|---|---|
| Styrene-butylacrylate resin | 100 parts by mass |
| Toluene | 100 parts by mass |
| Carbon black | 10 parts by mass |

Next, a mixture according to the above formula was dispersed for 20 minutes in a Homomixer and prepared a coating layer forming liquid. The coating layer forming liquid was coated onto the surface of 1000 parts by mass of spheroid magnetite having a particle diameter of 50 μm, utilizing a fluid bed coating apparatus, to yield magnetic carrier C.

Other than altering the carrier A of Embodiment C-2 to carrier C, magnetic toner and two-component developer were obtained as in Embodiment C-2, and subjected to various evaluations as in Embodiment C-2. The results are shown in Tables 5 and 6.

TABLE 5

| | *1 | Toner magnetization (5 kOe) | D25/D75 | *2 | composition of carrier coating layer | Fluidity imparting agent |
|---|---|---|---|---|---|---|
| Embodiment C-1 | 5.2 | 24.0 emμ/g | 0.71 | 4.3 | *3 | Hydrophobic Silica |
| Embodiment C-2 | 6.1 | 16.9 | 0.73 | 3.6 | *3 | *4 |
| Embodiment C-3 | 15.2 | 16.8 | 0.68 | 3.1 | *3 | *4 |
| Embodiment C-4 | 34.6 | 16.5 | 0.63 | 3.7 | *3 | *4 |
| Embodiment C-5 | 58.2 | 16.1 | 0.61 | 2.1 | *3 | *4 |
| Embodiment C-6 | 20.1 | 16.8 | 0.72 | 3.2 | *3 | *4 |
| Embodiment C-7 | 18.4 | 16.7 | 0.66 | 3.7 | *3 | *4 |

TABLE 5-continued

| | *1 | Toner magnetization (5 koe) | D25/D75 | *2 | composition of carrier coating layer | Fluidity imparting agent |
|---|---|---|---|---|---|---|
| Embodiment C-8 | 6.1 | 16.9 | 0.73 | 3.6 | *3 | *4 |
| Comp. Ex. C-1 | 63.2 | 0.1 | 0.57 | 7.1 | *3 | *4 |

*1: Number average percent of particles having diameter of 4 μm or less
*2: Volume percent of the toners having twice or more larger diameter than the weight average particle diameter
*3: Silicon Resin and Carbon Black
*4: Hydrophobic Silica and hydrophobic titanium oxide

TABLE 6

| | initially | | | | after 500,000 copies | | | |
|---|---|---|---|---|---|---|---|---|
| | image density | image irregularity | resolution | image density controllability | image density | image irregularity | resolution | image density controllability |
| Embodiment C-1 | 1.45 | ◎ | 5.6 | ◎ | 1.38 | ◎ | 5.6 | ○ |
| Embodiment C-2 | 1.42 | ◎ | 6.3 | ◎ | 1.35 | ◎ | 5.6 | ○ |
| Embodiment C-3 | 1.39 | ○ | 7.1 | ○ | 1.37 | ○ | 6.3 | ○ |
| Embodiment C-4 | 1.34 | ○ | 7.1 | ○ | 1.35 | ○ | 7.1 | ○ |
| Embodiment C-5 | 1.31 | ○ | 7.1 | ○ | 1.33 | Δ | 7.1 | ○ |
| Embodiment C-6 | 1.37 | ◎ | 7.1 | ◎ | 1.32 | ◎ | 7.1 | ○ |
| Embodiment C-7 | 1.35 | ○ | 7.1 | ○ | 1.31 | ○ | 7.1 | ○ |
| Embodiment C-8 | 1.39 | ◎ | 6.3 | ◎ | 1.21 | Δ | 5.6 | ○ |
| Comp. Ex. C-1 | 1.30 | X | 7.1 | X | | | | |

What is claimed is:

1. A two component developer, comprising:

a) a magnetic toner containing a binder resin and a magnetic particle; and b) a magnetic carrier containing a magnetic particle;

wherein the magnetic toner has an average particle diameter of 4.0 to 10.0 μm, and contains 5 to 80 No. % of toner particles having particle diameter of 5 μm or less, and exhibits a magnetization of 10 to 25 emu/g under a magnetic field of 5 kiloersteds.

2. The two-component developer according to claim 1, wherein the magnetic toner has an average particle diameter of 6.0 to 8.0 μm, and contains 40 to 80 No. % of toner particles having particle diameter of 5 μm or less, and exhibits a magnetization of 7 to 20 emu/g under a magnetic field of 1 kiloersteds.

3. The two-component developer according to claim 1, wherein the magnetic toner has an average particle diameter of 6.0 to 10.0 μm, and contains 5 to 60 No. % of toner particles having particle diameter of 5 μm or less, and contains 2 vol. % or more of the magnetic particles having a diameter of 12.7 μm or more.

4. The two-component developer according to claim 1, wherein the magnetic toner comprises 5 vol. % or less of toner particles having a particle diameter twice or more larger than the weight-average particle diameter, and 5 to 60 No. % of magnetic toner particles having a particle diameter of 4 μm or less, and a ratio between a number-average particle diameter (D25) and a number-average particle diameter (D75), which is expressed as D25/D75, is 0.60 or greater.

5. The two-component developer according to claim 1, wherein the magnetic toner is obtained by classifying the particles thereof into at least a coarse powder region, a medium powder region, and a fine powder region, by a classifier.

6. The two-component developer according to claim 1, wherein the magnetic toner contains a fluidity imparting agent mixed therein.

7. The two-component developer according to claim 6, wherein the fluidity imparting agent contains at least one of hydrophobic silicon oxide fine particles and hydrophobic titanium oxide fine particles.

8. The two-component developer according to claim 1, wherein the magnetic carrier has a coating layer.

9. The two-component developer according to claim 8, wherein the coating layer comprises a silicone resin.

10. The two-component developer according to claim 8, wherein the coating layer comprises a carbon black.

11. The two-component developer according to claim 8, wherein the coating layer comprises a coupling agent.

12. The two-component developer according to claim 8, wherein thickness of the coating layer is 0.1 to 20 μm.

13. An image forming apparatus, comprising:

a) a latent image carrier;

b) charging means for charging the latent image carrier;

c) exposing means for exposing the latent image carrier to light imagewise so as to form a latent electrostatic image thereon;

d) developing means for developing the latent electrostatic image to a developed image with a two-component developer which comprises a magnetic toner containing a binder resin and a magnetic particle, and a magnetic carrier containing a magnetic particle, the magnetic toner having an average particle diameter of 4.0 to 10.0 μm, and contains 5 to 80 No. % of toner particles having particle diameter of 5 μm or less, and exhibits a magnetization of 10 to 25 emu/g under a magnetic field of 5 kiloersteds; and e) transfer means for transferring the developed image to a recording medium;

wherein the developing means comprises:

a developer carrier having magnetic field generating means internally therein and carrying the two-component developer on the surface thereof; and a layer thickness controlling member for controlling a thickness of the two-component developer carried on the developer carrier to an even thickness.

14. The image forming apparatus according to claim 13, wherein the developer carrier is capable of rotating, and the layer thickness controlling member comprises: a second layer thickness controlling member for controlling thickness of a two-component developer carried on the developer carrier to a predetermined value; and a first layer thickness controlling member for further controlling a thickness of the two-component developer controlled by the second layer thickness controlling member to a predetermined value and accommodating excessive amount of the two-component developer in a developer accommodation unit.

15. An image forming method, comprising:

a step for charging a latent image carrier;

a step for exposing the latent image carrier to light imagewise so as to form a latent electrostatic image thereon;

a step for developing the latent electrostatic image to form a visible developed image by supplying a two-component toner developer carried on the developer carrier;

a step for transferring the developed image to a recording medium:

wherein the two-component toner developer comprises a magnetic toner containing a binder resin and a magnetic particle, and a magnetic carrier containing a magnetic particle, the magnetic toner has an average particle diameter of 4.0 to 10.0 $\mu$m, and contains 5 to 80 No. % of toner particles having particle diameter of 5 $\mu$m or less, and exhibits a magnetization of 10 to 25 emu/g under a magnetic field of 5 kiloersteds.

16. The image forming method according to claim 15, wherein, the thickness of the two-component developer carried on the developer carrier is controlled by a second layer thickness controlling member, and further controlled by the first layer thickness controlling member into an even thickness.

17. An image forming apparatus, comprising:

a) a latent image carrier;

b) a charger;

c) an exposer;

d) a developer; and e) a transferer;

wherein the developer comprises:

a developer carrier having magnetic field generator internally therein and carrying a two-component developer on the surface thereof; and a layer thickness controlling member for controlling a thickness of the two-component developer carried on the developer carrier to an even thickness; and wherein said two-component developer comprises a magnetic toner containing a binder resin and a magnetic particle, and a magnetic carrier containing a magnetic particle, the magnetic toner having an average particle diameter of 4.0 to 10.0 $\mu$m, and contains 5 to 80 No. % of toner particles having particle diameter of 5 $\mu$m or less, and exhibits a magnetization of 10 to 25 emu/g under a magnetic field of 5 kiloersteds.

18. The image forming apparatus according to claim 17, wherein the developer carrier is capable of rotating, and the layer thickness controlling member comprises: a second layer thickness controlling member for controlling thickness of a two-component developer carried on the developer carrier to a predetermined value; and a first layer thickness controlling member for further controlling a thickness of the two-component developer controlled by the second layer thickness controlling member to a predetermined value and accommodating excessive amount of the two-component developer in a developer accommodation unit.

19. An image forming method, comprising:

charging a latent image carrier;

exposing the latent image carrier to light imagewise so as to form a latent electrostatic image thereon;

developing the latent electrostatic image to form a visible developed image by supplying a two-component toner developer carried on the developer carrier;

transferring the developed image to a recording medium;

wherein the two-component toner developer comprises a magnetic toner containing a binder resin and a magnetic particle, and a magnetic carrier containing a magnetic particle, the magnetic toner has an average particle diameter of 4.0 to 10.0 $\mu$m, and contains 5 to 80 No. % of toner particles having particle diameter of 5 $\mu$m or less, and exhibits a magnetization of 10 to 25 emu/g under a magnetic field of 5 kiloersteds.

20. The image forming method according to claim 19, wherein, the thickness of the two-component developer carried on the developer carrier is controlled by a second layer thickness controlling member, and further controlled by the first layer thickness controlling member into an even thickness.

* * * * *